US012649983B2

(12) United States Patent
Ramaratnam et al.

(10) Patent No.: US 12,649,983 B2
(45) Date of Patent: Jun. 9, 2026

(54) HYDRO-PATTERNED NONWOVEN AND METHOD OF MAKING THE SAME

(71) Applicants: PFNONWOVENS LLC, Hazleton, PA (US); PFNONWOVENS HOLDING S.R.O, Prague (CZ)

(72) Inventors: Karthik Ramaratnam, Anderson, SC (US); Peter Zajaczkowski, Greenville, SC (US); John C. Parsons, Annville, PA (US); Pavlina Kasparkova, Znojmo (CZ)

(73) Assignees: PFNONWOVENS LLC, Hazleton, PA (US); PFNONWOVENS HOLDING S.R.O, Praque (CZ)

( * ) Notice: Subject to any disclaimer, the term of this patent is extended or adjusted under 35 U.S.C. 154(b) by 798 days.

(21) Appl. No.: 17/735,673

(22) Filed: May 3, 2022

(65) Prior Publication Data

US 2022/0364281 A1 Nov. 17, 2022

Related U.S. Application Data

(60) Provisional application No. 63/183,148, filed on May 3, 2021.

(51) Int. Cl.
*D04H 1/46* (2012.01)

(52) U.S. Cl.
CPC ..... *D04H 1/465* (2013.01); *D10B 2321/021* (2013.01); *D10B 2321/022* (2013.01)

(58) Field of Classification Search
CPC . D04H 1/465; D04H 3/11; D04H 3/14; D04H 3/147; D10B 2321/021; D10B 2321/022
USPC ..... 442/384
See application file for complete search history.

*Primary Examiner* — Camie S Thompson
(74) *Attorney, Agent, or Firm* — Amster, Rothstein & Ebenstein LLP

(57) ABSTRACT

A method of forming a hydro-patterned nonwoven web including the steps of forming a nonwoven batt comprising continuous spunmelt fibers, calender bonding the nonwoven batt to form a thermobonded precursor nonwoven web with a bond pattern that defines bond impressions and unbonded areas between the individual bond impressions, and hydraulically treating the thermobonded precursor nonwoven by a plurality of steps of water injection as the thermobonded nonwoven web passes over a screen. The bond pattern has specific features that provide advantages in terms of mechanical properties and visual appearance of the final nonwoven product.

42 Claims, 25 Drawing Sheets

PATTERN P1

PATTERN P6

PATTERN P2

PATTERN P7

PATTERN P3

PATTERN P5

PATTERN P8

FIG. 11

TABLE 1

| Pattern | P1 | P2 | P3 | P4 | P5 | P6 | P7 | P8 |
|---|---|---|---|---|---|---|---|---|
| Figure | 4A, 4B | 6A, 6B | 8A, 8B | 3B | 9 | 5 | 7A, 7B | 10A, 10B |
| Pattern type | Small BI | Combination of larger BI | Discontinuous line shaped BI | Discontinuous line shaped BI with convex portion | Combination of large and small BI | Small BI | Continues line shaped BI with convex portion | Combination of discontinuous line shaped and small BI |
| Free filaments area | Regular pattern | Varying pattern | Regular pattern | Regular pattern | Varying pattern | Varying pattern | Varying pattern | Varying pattern |
| Bond area percentage | 18 % | 24.2% | 14 % | 13% | 22.1% | 17.5% | 14% | 14% |
| BI/cm² | 49.9 | 17.6 | 9 | 2.4 | 11.1 | 44.8 | N/A | 15.3 |
| Comprise small BI | yes | no | no | no | no | yes | no | yes |
| Comprise large BI | no | yes | yes | yes | yes | no | yes | yes |
| line shaped large BI (width / length) | no | no | yes 0.4 mm / 4 mm | yes 0.4 mm / 9 mm | no | no | yes 0.4 mm / N/A | yes 0.6 mm / 2 mm |
| αT | 60° | N/A | 0° | 10° | N/A | N/A | N/A | N/A |
| Area of smallest BI | 0.36 mm² | 1.18 mm² | 1.56 mm² | 4.3 mm² | 0.9 mm² | 0.39 mm² | continuous | 0.5 mm² |
| Area of largest BI | 0.36 mm² | 1.76 mm² | 1.56 mm² | 4.3 mm² | 23.7 mm² | 0.39 mm² | continuous | 6 mm² |
| Circle C radius mm | 0.47 | 0.77 | 0.99 | 1.21 | 2.54 | 0.98 | 2.18 | 1.71 |
| Circle C area mm² | 0.68 | 0.47 | 0.78 | 1.14 | 5.06 | 0.75 | 3.75 | 2.29 |
| K | 21 | 9 | 39 | 85 | 229 | 24 | - | 214 |

HYDRO-PATTERNED NONWOVEN AND METHOD OF MAKING THE SAME

RELATED APPLICATIONS

This application claims priority to and the benefit of U.S. Provisional Application No. 63/183,148, filed May 3, 2021 and entitled HYDRO-PATTERNED NONWOVEN AND METHOD OF MAKING THE SAME, the contents of which are incorporated herein by reference in their entirety.

FIELD OF THE INVENTION

The present invention relates to hydro-patterned nonwovens and an improved method of manufacturing hydro-patterned nonwovens in which the nonwoven is imparted with a bond pattern before being subjected to hydraulic treatment.

BACKGROUND OF THE INVENTION

Spunmelt nonwovens (e.g., spunbond nonwovens, melt-blown nonwovens and combinations thereof) are formed of thermoplastic continuous fibers such as polypropylene (PP), polyethylene terephthalate (PET), etc., bi-component or multi-component fibers, as well as mixtures of such spunmelt fibers with rayon, cotton and cellulosic pulp fibers, etc. Conventionally, spunmelt nonwovens are thermally, ultrasonically, chemically (e.g., by latex), or resin bonded, etc., to produce bonds which are substantially non-frangible and retain their identity through post-bonding processing and conversion. Thermal and ultrasonic bonding produce permanent fusion bonds, while chemical bonding may or may not produce permanent bonding.

It is known to apply hydraulic treatment to improve fabric properties, such as softness or bulkiness. One known hydraulic treatment process, called hydroengorgement, is described in, for example, U.S. Pat. Nos. 7,858,544 and 10,767,296. It is also known to form apertures in nonwoven webs by many methods using different technical processes.

A method of forming a hydro-patterned nonwoven fabric from a thermobonded precursor web is needed that results in a product that exhibits an improved combination of properties, such as softness, abrasion resistance and tensile strength.

SUMMARY OF THE INVENTION

A method of forming a hydro-patterned nonwoven web according to an exemplary embodiment of the present invention, comprises: forming a nonwoven batt comprising continuous spunmelt fibers; calender bonding the nonwoven batt to form thermobonded precursor nonwoven web with a bond pattern that defines bond impressions and unbonded areas between the individual bond impressions; and hydraulically treating the thermobonded precursor nonwoven by a plurality of steps of water injection as the thermobonded nonwoven web passes over a screen, wherein the bond pattern has a percentage bond area of 10% to 25%, an imaginary circle C is defined as the largest circle that can be drawn among the unbonded areas and which has a perimeter that intersects with a single point on perimeters of each of at least two adjacent bond impressions within the bond pattern, and the circle C has a radius in the unbonded area of at least 0.5 mm, preferably at least 1.0 mm, more preferably at least 1.5 mm, even more preferably at least 2.0 mm, and the bond pattern comprises large-bold bonding impressions with a bond impression area of at least 1 $mm^2$.

In an exemplary embodiment, the step of forming the precursor web comprises the spunmelt fibers of the nonwoven batt consisting of spunbond filaments.

In an exemplary embodiment, the step of forming the precursor web comprises the nonwoven batt comprising two or more layers.

In an exemplary embodiment, the spunmelt fibers in each of the two or more layers comprise spunbond filaments.

In an exemplary embodiment, an average fiber thickness difference between the layers is less than 20%, preferably less than 15%, more preferably less than 10%, even more preferably less than 5%.

In an exemplary embodiment, at least one layer of the two or more layers comprises spunbond filaments and at least one other layer of the two or more layers comprises melt-blown fibers.

In an exemplary embodiment, the at least one layer comprising spunbond filaments forms at least one outer layer of the nonwoven batt.

In an exemplary embodiment, the two or more layers comprise at least three layers that form a spunbond-melt-blown-spunbond (SMS) structure.

In an exemplary embodiment, the method further comprises the step of applying at least one layer formed of fibers and/or particles to the fully bonded nonwoven precursor web before the step of hydraulically treating.

In an exemplary embodiment, the fibers are short synthetic fibers, preferably polyester based staple fibers or viscose fibers.

In an exemplary embodiment, the fibers are natural fibers, preferably cotton fibers or pulp or modified cellulose such as rayon.

In an exemplary embodiment, the step of forming the precursor web comprises continuous spunmelt fibers comprising polyolefin or polyamide or polyester or polysaccharide homopolymer, copolymer or polymer blend.

In an exemplary embodiment, the step of forming the precursor web comprises the continuous spunmelt fibers comprising polypropylene, polyethylene, polylactic acid, polyhydroxyalkanoates, polyhydroxybutyrate, polybutylene succinate, polyethylene terephthalate, thermoplastic starch, their copolymers, their copolymers with olefins, esters, amides or other polymers or blends thereof.

In an exemplary embodiment, the step of forming the precursor web comprises the spunmelt fibers comprising multi-component, preferably bicomponent, continuous spunmelt fibers.

In an exemplary embodiment, a component polymer composition present on at least 40% of each filament surface, preferably on at least 50% of each filament surface, more preferably on at least 60% of each filament surface, even more preferably covering an entirety of each filament surface has a melting temperature that is lower as compared to a melting temperature of at least one other component polymer composition, preferably with a difference of at least 2° C., more preferably with a difference of at least 5° C.

In an exemplary embodiment, the step of forming the precursor web comprises the spunmelt fibers comprising bicomponent core-sheath continuous spunmelt fibers with a core comprising polypropylene and a sheath comprising a blend of polypropylene and copolymer polypropylene-polyethylene.

In an exemplary embodiment, the continuous spunmelt fibers comprise additives

In an exemplary embodiment, the additives comprise additives of a type selected from the group consisting of: color pigments, softness enhancers, slip agents, fillers and combinations thereof.

In an exemplary embodiment, the step of forming the precursor web comprises the bond pattern comprising small bonding impressions with a bond impression area less than 1 $mm^2$.

In an exemplary embodiment, the step of forming the precursor web comprises the circle C having a radius of at least 1 mm, preferably at least 2 mm, more preferably at least 3 mm, even more preferably at least 4 mm.

In an exemplary embodiment, the step of forming the precursor web comprises the smallest distance between the adjacent bonding impressions being at least 0.3 mm, preferably at least 0.4 mm, most preferably at least 0.5 mm.

In an exemplary embodiment, the step of forming the precursor web comprises the bonding impression having the shape of a line with constant width, the line width (W) of maximum 0.6 mm, preferably of maximum 0.5 mm, most preferably of maximum 0.4 mm.

In an exemplary embodiment, the step of forming the precursor web comprises the bonding impression having the shape of a line with irregular width, the maximum line width (W) of maximum 0.6 mm, preferably of maximum 0.5 mm, most preferably of maximum 0.4 mm.

In an exemplary embodiment, the step of forming the precursor web comprises the bonding impressions having the shape of a line with bond shape perimeter comprising at least one convex portion.

In an exemplary embodiment, the step of forming the precursor web comprises the bonding impressions having the shape of a continuous line.

In an exemplary embodiment, the step of forming the precursor web comprises the bonding impressions having the shape of a line with the length (L) at maximum 30 mm, preferably of maximum 25 mm, more preferably of maximum 20 mm.

In an exemplary embodiment, the step of forming the precursor web comprises the bond pattern comprising large-bold bonding impressions with bond impression area equal or larger than 1 $mm^2$.

In an exemplary embodiment, the step of hydraulically treating comprises applying hydraulic pressure to the nonwoven precursor web with water jets.

In an exemplary embodiment, the step of hydraulically treating comprises applying hydraulic pressure to the nonwoven precursor web by at least two sets of water injectors In an exemplary embodiment, the method is performed at a line speed of at least 150 m/min.

In an exemplary embodiment, the line speed is 450 m/min or less.

A hydro-patterned nonwoven web according to an exemplary embodiment of the present invention is produced a process that includes any of the above-mentioned steps.

In an exemplary embodiment, the hydro-patterned nonwoven web has a basis weight of 60 gsm or less, preferably 50 gsm or less, more preferably 45 gsm or less, even more preferably 35 gsm or less.

In an exemplary embodiment, the hydro-patterned nonwoven web has an MD tensile strength of at least 4 N/cm.

In an exemplary embodiment, the hydro-patterned nonwoven web has a CD tensile strength of at least 2 N/cm.

In an exemplary embodiment, the hydro-patterned nonwoven web has a caliper of at least 10 microns/gsm of fabric, preferably of at least 11 microns/gsm of fabric, most preferably of at least 12 microns/gsm of fabric.

In an exemplary embodiment, the step of hydraulically treating comprises applying hydraulic pressure to the nonwoven precursor web by more than one set of water injectors with each set of water injectors applying a pressure that is greater than a pressure applied by a set of water injectors preceding the set of water injectors in the machine direction.

In an exemplary embodiment, the more than one set of water injectors comprise a first set of water injectors, a second set of water injectors preceding the first set of water injectors in the machine direction and a third set of water injectors preceding the first and second water injectors in the machine direction, the second set of water injectors apply a pressure of between 80% to 95% of the pressure applied by the first set of water injectors, and the third set of water injectors apply a pressure of between 64% to 90% of the pressure applied by the second set of water injectors.

In an exemplary embodiment, the step of hydraulic treatment comprises at least partially altering the individual bond impressions by application of water pressure.

In an exemplary embodiment, the step of at least partially altering results in at least 60% of fully bonded portions of the individual bond impressions remaining after the step of hydraulically imparting.

In an exemplary embodiment, the step of at least partially altering results in at least 70% of fully bonded portions of the individual bond impressions remaining after the step of hydraulically imparting.

In an exemplary embodiment, the step of at least partially altering results in at least 80% of fully bonded portions of the individual bond impressions remaining after the step of hydraulically imparting.

In an exemplary embodiment, the step of at least partially altering results in at least 90% of fully bonded portions of the individual bond impressions remaining after the step of hydraulically imparting.

In an exemplary embodiment, the step of at least partially altering results in separating the individual bond impressions into at least two portions.

In an exemplary embodiment, the step of at least partially altering results in fibers in areas around perimeters of the individual bond impressions randomly frayed in and out of a major plane of the fully bonded precursor nonwoven web so as to at least partially eliminate three-dimensionality of the individual bond impressions.

A method of forming a hydro-patterned nonwoven web according to an exemplary embodiment of the present invention comprises: forming a nonwoven batt comprising continuous spunmelt fibers; calender bonding the nonwoven batt to form thermobonded precursor nonwoven web with a bond pattern that defines bond impressions and unbonded areas between the individual bond impressions; and hydraulically treating the thermobonded precursor nonwoven by a plurality of steps of water injection as the thermobonded nonwoven web passes over a screen, wherein the bond pattern has a percentage bond area of 10% to 25%, the bond pattern comprises small bonding impressions with a bond impression area less than 1 $mm^2$, and the bond pattern comprises large bonding impressions with a bond impression area of at least 1 $mm^2$.

A method of forming a hydro-patterned nonwoven web according to an exemplary embodiment of the present invention comprises: forming a nonwoven batt comprising continuous spunmelt fibers; calender bonding the nonwoven batt to form a thermobonded precursor nonwoven web with a bond pattern that defines bond impressions and unbonded areas between the individual bond impressions; and hydraulically treating the thermobonded precursor nonwoven by a plurality of steps of water injection as the thermobonded nonwoven web passes over a screen, wherein the regular bond pattern has a percentage bond area of 10% to 25%, the bond pattern formed in the calender bonding step comprises large bonding impressions with a bond impression area of at least 1 $mm^2$, the bonding impression has the shape of a line with irregular width, the maximum line width (W) of maximum 0.6 mm, preferably of maximum 0.5 mm, most preferably of maximum 0.4 mm, and bonding impression has the shape of a line with a length (L) of at most 30 mm, preferably at most 25 mm, more preferably at most 20 mm.

BRIEF DESCRIPTION OF THE DRAWINGS

The above and related objects, features and advantages of the present invention will be more fully understood by reference to the following, detailed description of the preferred, albeit illustrative, embodiment of the present invention when taken in conjunction with the accompanying figures, wherein:

FIG. 11 provides Table 1 including certain characteristics of various bond patterns useable with methods for forming a hydro-patterned nonwoven web according to an exemplary embodiment of the present invention;

DETAILED DESCRIPTION

Figure 1:
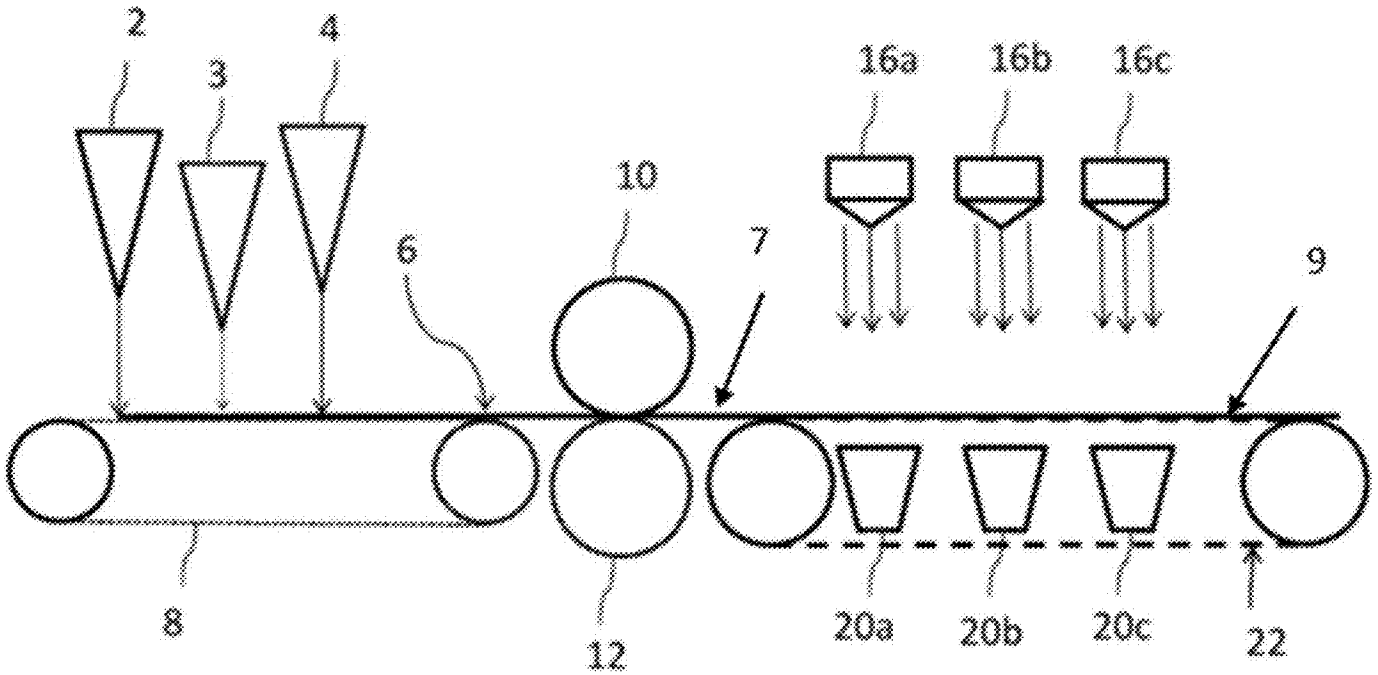
FIG. 1 is a representational diagram of a system for forming a hydro-patterned nonwoven web according to an exemplary embodiment of the present invention.

The present invention is directed to improved techniques for hydraulically treating nonwoven fabrics and nonwoven fabrics made using these methods. The hydraulically treated fabrics described herein are referred to as "hydro-patterned" fabrics.

A nonwoven web hydraulically treated in accordance with the present invention may be suitable for use in disposable absorbent articles. As used herein, the term "absorbent article" refers to articles which absorb and contain fluids and solid materials. For example, absorbent articles may be placed against or in proximity to the body to absorb and contain the various exudates discharged by the body. Absorbent articles may be articles that are worn, such as baby diapers, adult incontinence products, and feminine care products, or hygienic products that are used to absorb fluids and solid materials, such as for the medical profession which uses products like disposable gowns and chucks. In particular, nonwovens in accordance with exemplary embodiments of the present invention may be used as or as part of a body contacting layer of an absorbent article, such as a topsheet, or used to form other components of absorbent articles, such as, for example, a backsheet, waist belt, or fastening tabs. The nonwovens in accordance with exemplary embodiments of the present invention may also be used for packaging or wrapping items such as absorbent articles. The term "disposable" is used herein to describe absorbent articles which are not intended to be laundered or otherwise restored or reused as an absorbent article, but instead are intended to be discarded after a single use and, preferably, to be recycled, composted or otherwise disposed of in an environmentally compatible manner.

The term "disposable" is used herein to describe absorbent articles which are not intended to be laundered or otherwise restored or reused as an absorbent article, but instead are intended to be discarded after a single use and, preferably, to be recycled, composted or otherwise disposed of in an environmentally compatible manner.

The terms "fibers" and "filaments" are used interchangeably in this application unless otherwise specified (for example, "endless filaments" or "short fibers", etc).

The term "batt" is used herein to refer to fiber materials prior to being bonded to each other. A "batt" comprises individual fibers, which are usually unbonded to each other, although a certain amount of pre-bonding between fibers may be performed, and this pre-bonding may occur during or shortly after the lay-down of fibres in a spun-melt process, for example. This pre-bonding, however, still permits a substantial number of the fibers to be freely movable such that they can be repositioned. A "batt" may comprise several layers, resulting by depositing fibers from several spinning heads in a spun-melt process, and distributions of a fiber diameter thickness and a porosity in the "sub layers" laid-down from individual heads do not differ significantly. Adjacent layers of fibers need not be separated from each other by a sharp transition, and individual layers may blend partly in the area around the boundary.

The terms "nonwoven, nonwoven fabric, sheet or web" as used herein refer to a manufactured sheet or web of directionally or randomly oriented fibers or filaments which are first formed into a batt and then one or more batts are laid one on each other and consolidated and bonded together by friction, cohesion, adhesion or one or more patterns of bonds and bonding impressions created through localized compression and/or application of pressure, heat, ultrasonic, or heating energy, or a combination thereof. The term does not include fabrics which are woven, knitted, or stitch-bonded with yarns or filaments. The fibers may be of natural or man-made origin and may be staple or continuous filaments or be formed in situ. Commercially available fibers have diameters ranging from about 0.0005 mm to about 0.25 mm and they come in several different forms: short fibres (known as staple, or chopped), continuous single fibres (filaments or monofilaments), untwisted bundles of continuous filaments (tow), and twisted bundles of continuous filaments (yarn). Nonwoven fabrics can be formed by many processes including but not limited to melt-blowing, spun-bonding, spun-melting, solvent spinning, electro-spinning, carding, film fibrillation, melt-film fibrillation, air-laying, dry-laying, wet-laying with staple fibres and combinations of these processes as known in the art. The basis weight of nonwoven fabrics is usually expressed in grams per square meter (gsm).

The term "spunmelt fibers" refers to fibers formed by heating thermoplastic polymers (e.g., polypropylene, polyester or nylon) and extruding them through a metal plate with hundreds of holes in it, known as a spinneret or die. Examples of spunmelt fibers include spunbond fibers and meltblown fibers. Spunmelt fibers might be monocomponent in that they are formed of a single polymer component or a single blend of polymer components or multicomponent where the cross-section of each fiber comprises at least two discrete polymer components or blends of polymer components, or at least one discrete polymer component and at least one discrete blend of polymer components. Fibers with two discreet components may be referred to as bicomponent fibers.

Webs or fabrics made with spunmelt fibers may be referred to as "spunmelt webs or fabrics."

The term "spunbond fibers" as used herein means substantially continuous fibers or filaments having an average diameter in the range of 10-30 microns. Splitable bicomponent or multicomponent fibers having an average diameter in the range of 10-30 microns prior to splitting are also included.

The term "meltblown fibers" as used herein means substantially continuous fibers or filaments having an average diameter of less than 10 microns.

The term "fully bonded nonwoven" as used herein, and as well understood by one skilled in the art, refers to a nonwoven that has fibers that are fused to one another at bonding impressions via melting and solidification. Such a fabric might be used itself for various applications, e.g. converted into a diaper, etc., or used as a precursor for further treatment (e.g. hydrophilic spinfinish application or hydraulic treatment). For example, a fully calender bonded nonwoven may be produced by passing a batt through a nip point between two heated rolls under pressure, thereby providing a pattern of fused embossed impressions in the fabric. The pressure and temperature within the nip are sufficient to soften and melt the individual fibers and to then weld them together using a pattern of protrusions on at least one of the heated rolls to create a series of fused bonding impressions where the majority of fibers within the fused bonding impression can no longer be distinguished as individual fibers. The bonding impressions results in fusion of fibers or in the case of bicomponent fibers in fusion of at least one component with the lowest melting temperature through the full thickness of the fabric. The roll temperature and pressure are adjusted dependent upon fabric formulation and basis weight. For example, a 20-25 gsm 100% polypropylene spunbond is typically bonded at roll temperatures of >150 deg C. and with a nip pressure greater than 90 N/mm. Temperature/pressure settings are adjusted to handle different basis weights and or line speeds. Higher basis weights and/or line speeds may require increased nip pressures and/or temperatures to achieve a "fully" bonded fabric with fused bond points. It should be appreciated that tack bonding is not within the scope of the definition of "fully bonded" for the purposes of this disclosure.

The term "bond area percentage" as used herein represents a ratio of an area occupied by bonding impressions to a total surface of a nonwoven fabric expressed as a percentage and measured according to the Bond Area Percentage Method set forth herein.

With respect to the making of a nonwoven web material and the nonwoven web material itself, "cross direction" (CD) refers to the direction along the web material substantially perpendicular to the direction of forward travel of the web material through the manufacturing line in which the web material is manufactured. With respect to a batt moving through the nip of a pair of calender rollers to form a bonded nonwoven web, the cross direction is perpendicular to the direction of movement through the nip, and parallel to the nip.

With respect to the making of a nonwoven web material and the nonwoven web material itself, "machine direction" (MD) refers to the direction along the web material substantially parallel to the direction of forward travel of the web material through manufacturing line in which the web material is manufactured. With respect to a nonwoven batt moving through the nip of a pair of calender rollers to form a bonded nonwoven web, the machine direction is parallel to the direction of movement through the nip, and perpendicular to the nip.

A "bonding protrusion" or "protrusion" is a feature of a bonding roller at its radially outermost portion, surrounded by recessed areas. Relative the rotational axis of the bonding roller, a bonding protrusion has a radially outermost bonding surface with a bonding surface shape and a bonding surface shape area, which generally lies along an outer cylindrical surface with a substantially constant radius from the bonding roller rotational axis; however, protrusions having bonding surfaces of discrete and separate shapes are often small enough relative the radius of the bonding roller that the bonding surface may appear flat/planar; and the bonding surface shape area is closely approximated by a planar area of the same shape. A bonding protrusion may have sides that are perpendicular to the bonding surface, although usually the sides have an angled slope, such that the cross section of the base of a bonding protrusion is larger than its bonding surface. A plurality of bonding protrusions may be arranged on a calender roller in a pattern. The plurality of bonding protrusions has a bonding area per unit surface area of the outer cylindrical surface which can be expressed as a percentage, and is the ratio of the combined total of the bonding shape areas of the protrusions within the unit, to the total surface area of the unit.

A "bonding impression" or "fused bonding impression" in a nonwoven web is the surface structure created by the impression of a bonding protrusion on a calender roller into a nonwoven web. A bonding impression is a location of deformed, intermeshed or entangled, and melted or thermally fused, materials from fibers superimposed and compressed in a z-direction beneath the bonding protrusion, which form a bond or a bonding area. The individual bonds may be connected in the nonwoven structure by loose fibres between them. The shape and size of the bonding impression approximately corresponds to the shape and size of the bonding surface of a bonding protrusion on the calender roller. For the purposes of this document a "bonding impression thickness" is understood to mean a width of a bonding impression area in a nonwoven web plane. One or both of the rollers may have their circumferential surfaces machined, etched, engraved or otherwise formed to have thereon a bonding pattern of bonding protrusions and recessed areas, so that bonding pressure exerted on the batt at the nip is concentrated at the bonding surfaces of the bonding protrusions, and is reduced or substantially eliminated at the recessed areas. The bonding surfaces have bonding surface shapes. As a result, an impressed pattern of bonds between fibers forming the web, having bond impressions and bond shapes corresponding to the pattern and bonding surface shapes of the bonding protrusions on the roller, is formed on the nonwoven web. A repeating pattern of bonding protrusions and recessed areas may be formed onto a bonding roller. The bonding shapes depict raised surfaces of bonding protrusions on a roller, while the areas between them represent recessed areas. The bonding shapes of the bonding protrusions impress like-shaped bond impressions on the web in the calendering process.

A "drop" in mechanical properties, or in Tensile Strength, Abrasion rating, etc. as used herein represents the difference in fabric properties before and after the hydro-patterning process and can be calculated according to the formula [(value of final hydro-patterned fabric property)−(value of precursor property)]/(value of precursor property), wherein all values are expressed in the same units. Drop might be positive (increase of value during hydro-patterning process) or negative (decrease of value during hydro-patterning process) and might be expressed as a ratio (unitless) or as a percentage. For example, drop in MD Tensile Strength is calculated according to the formula: [(MD Tensile Strength of final hydro-patterned fabric)−(MD Tensile strength of precursor)]/(MD Tensile Strength of precursor).

FIG. 1 is a block diagram showing various components used in a process for making a patterned nonwoven web according to an exemplary embodiment of the present invention. Although the process shown in FIG. 1 results in a nonwoven web having an SMS structure (2; 3; 4), it should be appreciated that the process may be re-configured to form many other web structures comprising one or more spunbond layers and/or one or more meltblown layers, such as, for example, fabrics with single or multiple spunbond layers, more specific examples being S, SS, SSS, etc.; fabrics with a combination of spunbond and meltblown layers, typically with a spunbond layer forming at least one outer surface of the fabric, more specific asymmetric composition examples being SSMS, SMSSMMS, SSMMS, SMMMSS etc. fabrics or symmetric examples being SMS, SMMS, SMMMS, SSMSS etc. fabrics; fabrics combining spunmelt layers with other layers, more specific examples being a combination of spunmelt layers formed of endless filaments with short fibers formed from natural materials, etc. The nonwoven web structure is not limited to the examples provided herein, and one of ordinary skill in the art would understand that many other such structures may be obtained by varying the number and arrangement of process components.

In general, it should be appreciated that the number and configuration of beams is not limited to that shown and described herein, and in other exemplary embodiments, the number and configuration of beams may be varied to achieve different web structures. For example, a single spunbond beam may be used to form nonwoven batt 6 on conveyor belt 8 having a single spunbond layer, or multiple spunbond beams may be used to form batt 6 having a multi-spundbond layer structure, such as, for example SS, SSS, SSSS, etc. Layers formed by multiple beams might be the same or very similar to each other in terms of filament-type, process parameters, etc. so that the layers are substantially indistinguishable from one another to thereby form what appears to be a single layer structure or they might be produced differently from one another thereby forming an evidently layered nonwoven product.

In another exemplary embodiment, only spunbond beam 2 and meltblown beam 3 are used to form nonwoven batt 6 on conveyor belt 8. According to further exemplary embodiments of the invention, plural elements corresponding to beams 2, 3 may be incorporated in the system to form batt 6 with multiple respective layers, such as, for example SM, SMM, SSM, SSMM etc. Again, layers formed by multiple beams might be the same or very similar to each other in terms of filament-type, process parameters, etc. so that the layers are substantially indistinguishable from one another to thereby form what appears to be a single layer structure or they might be produced differently from one another thereby forming an evidently layered nonwoven product.

According to an exemplary embodiment of the invention, a spunmelt nonwoven batt 6 is made of continuous filaments that are laid down on a moving conveyor belt 8 in a randomized distribution. Resin pellets may be processed under heat into a melt and then fed through a spinneret (or spinning beams 2 and 4) to create hundreds of filaments by use of a drawing device (not shown). Multiple spinnerets or beams (blocks in tandem) may be used to provide an increased density of spunbond fibers corresponding to, for example, each of spinning beams 2 and 4. Jets of a fluid (such as air) cause the fibers from beams 2 and 4 to be elongated, and the fibers are then blown or carried onto a moving web (conveyor belt) 8 where they are laid down and sucked against the web 8 by suction boxes (not shown) in a random pattern to create a batt 6. A meltblown layer may be deposited by a meltblown mechanism (or "beam") 3, preferably between spunbond layers laid by spinning beams 2 and 4. The meltblown ("MB") layer can be formed by a meltblown process but may be formed by a variety of other known processes. For example, the meltblowing process includes inserting a thermoplastic polymer into a die. The thermoplastic polymer material is extruded through a plurality of fine capillaries in the die to form fibers. The fibers stream into a high velocity gas (e.g. air) stream which attenuates the streams of molten thermoplastic polymer material to reduce their diameter, which may be to the microfiber diameter. The meltblown fibers are quasi-randomly deposited by beam 3 over the moving web or moving web with spunbond layer laid by spinning beam 2 to form a meltblown layer. One, two or more meltblown blocks may be used in tandem in order to increase the coverage of fibers. The meltblown fibers can be tacky when they are deposited, which generally results in some bonding between the meltblown fibers of the web.

In a preferred embodiment, the fibers used to form batt 6 are thermoplastic polymers, examples of which include polyolefins (e.g. polypropylene "PP" or polyethylene "PE"), polyesters (e.g., polylactic acid "PLA" or polyhydroxyalkanoates "PHA" or polyhydroxybutyrate "PHB" or polybutylene succinate "PBS" or polyethylene terephthalate "PET", etc.), polyamides, polysaccharides (e.g. thermoplastic starch "TPS" or starch based polymers, etc.) copolymers thereof (with olefins, esters, amides or other monomers) and blends thereof. Preferably the fibers are made from polyolefins, examples of which include polyethylene, polypropylene, propylene-butylene copolymers thereof and blends thereof, including, for example, ethylene/propylene copolymers and polyethylene/polypropylene blends. Resins with higher crystallinity and lower break elongations may also be suitable due to likelihood to fracture with greater ease. Fibers might be also formed, for example, from non-oil-based components, such as aliphatic polyesters, thermoplastic polysaccharides or other biopolymers, or they may contain these substances as additives or modifiers. As used herein, the term "blend" includes a homogeneous or semi-homogenous mixture of at least two polymers.

Another approach has involved forming a nonwoven web of multicomponent or preferably "bicomponent" polymer fibers. Such bicomponent polymer fibers may be formed by spinnerets that have two adjacent sections, that express a first component from one polymer or blend and a second component from the other, to form a fiber having a cross section of the first component in one portion and the second component in the other (hence the term "bicomponent"). The respective components may be with advantage selected to have differing melting temperatures and/or expansion-contraction rates. These differing attributes of the two polymers, when combined in a side by side or asymmetric sheath-core geometry might cause the bicomponent fiber products to curl in the spinning process, as they are cooled and drawn from the spinnerets. The resulting curled fibers then may be laid down in a batt and calender-bonded in a pattern. It is thought that the curl in the fibers adds loft and fluff to the web, enhancing visual and tactile softness signals.

In an exemplary embodiment, batt 6 may be thermally calender bonded via rollers 10 and 12. One or both of the rollers 10 and 12 may have their circumferential surfaces machined, etched, engraved or otherwise formed to have thereon a pattern of protrusions and recessed areas, so that bonding pressure exerted on the batt 6 at the nip is concentrated at the outward surfaces of the protrusions, and reduced or substantially eliminated at the recessed areas. According to an exemplary embodiment of the invention, roller 10 is a calender roll and roller 12 is a bonding roll defining a bond pattern. The thermal calendaring results in a thermobonded precursor web 7, preferably a fully bonded precursor web 7. Preferred bond patterns in accordance with exemplary embodiments of the present invention are described further below.

In accordance with an exemplary embodiment of the invention, precursor nonwoven web 7 is then hydraulically treated using one or more water jet injectors. Although FIG. 1 shows three water injectors 16*a*, 16*b*, and 16*c*, it should be appreciated that the process may involve the use of only one injector. The one or more injectors are included in a single water treating station. According to an exemplary embodiment of the invention, as precursor nonwoven web 7 is conveyed under the injectors 16*a-c* by a belt 22, high pressure water jets of the water injectors act against and pass through the fabric. Again, although FIG. 1 shows thee water injectors, it should be appreciated that the number of water injectors is not limited to three and there may be any number and arrangement of water injectors as appropriate for the particular line. In exemplary embodiments, there can be one or more water injectors, preferably two to six water injectors, more preferably three to four water injectors.

Corresponding water removal systems 20*a*, 20*b*, and 20*c* may be positioned under the location of each injector (set) 16*a-c* to pull the water away and dry the precursor fabric 7. The water removal systems 20*a*, 20*b* and 20*c* may include, for example, vacuum boxes, suction boxes, Uhle boxes, fans and/or vacuum slots. Nonwoven precursor web 7 may subsequently be dried by blowing hot air through the fibrous web, by IR dryers or other drying techniques (e.g., air drying).

According to an exemplary embodiment of the invention, belt 22 may incorporate one or more screens each with a predetermined pattern for supporting precursor nonwoven web 7 while it is being hydraulically treated by respective water injectors 16*a*-16*c*. As explained in further detail below with reference to FIGS. 2A and 2B, the one or more screens may be replaced with one or more drums 14, with the one drum or the last drum in a series of drums provided with a sleeve 18.

In accordance with an exemplary embodiment of the invention, the use of one or more drums with each drum being associated with one or more water injectors, results in a plurality of steps of water injection. The desired water pressure at each step depends on a number of parameters, including the number of water injection steps and the line speed. In general, the more water injection steps used in the process, the less pressure is required at each step to achieve the desired fabric properties. In other words, the energy flux attained using a number of water injectors each applying an amount of water pressure can also be attained by increasing the number of water injectors and decreasing the amount of water pressure applied by each injector. The desired water pressure at each step also depends at least partially on the line speed. Higher line speed requires higher pressure to maintain constant flux. In other words, the energy flux attained using a line speed and injector pressure can also be attained by reducing both the line speed and injector pressure.

Without being bound by theory, it is believed the preferred total water jet pressure applied to the precursor web 7 may be expressed in terms of energy flux. In accordance with an exemplary embodiment, the preferred energy flux applied to the precursor web 7 is within the range of 0.1-1.5 kWh/kg, preferably within the range 0.2-1.0 kWh/kg. The desired energy flux may be obtained by, for example, varying machine speed and/or water pressure at each water injector. Preferably, the desired energy flux is achieved by using one or more water injectors at a relatively lower pressure rather than less water injectors at a higher pressure. Energy flux is calculated using the following formula:

Flux=((J^1.5)*(G^2)*(I)*(L/1000)*(7/10000000000))/F where:

$$\text{Flux} = \frac{J^{1.5} \times G^2 * I * \frac{L}{1*10^3} * \frac{7}{1*10^{10}}}{F} \text{kWh/kg}$$

Figure 2A:
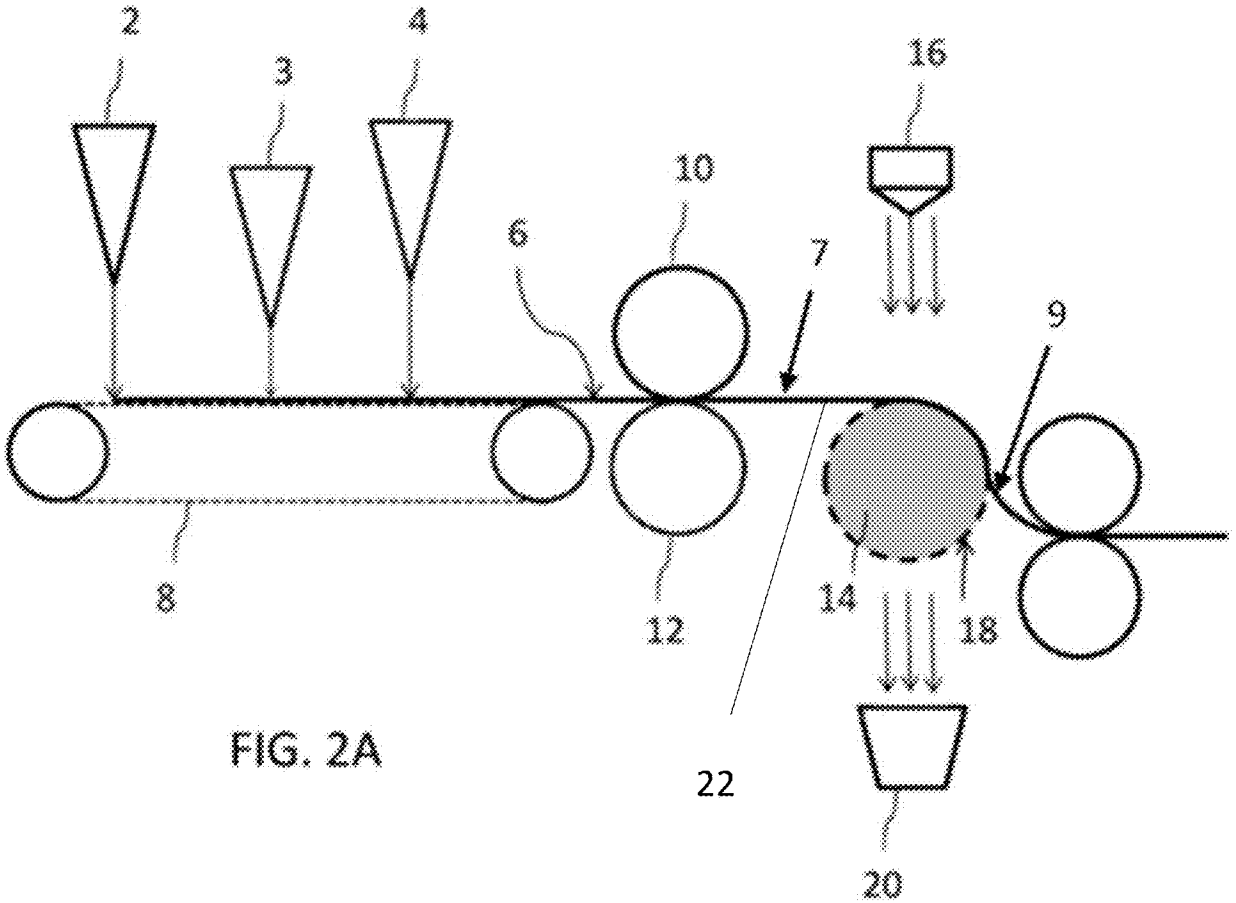
FIGS. 2A and 2B are representational diagrams of systems for forming a hydro-patterned nonwoven web according to an exemplary embodiment of the present invention.
Figure 2B:
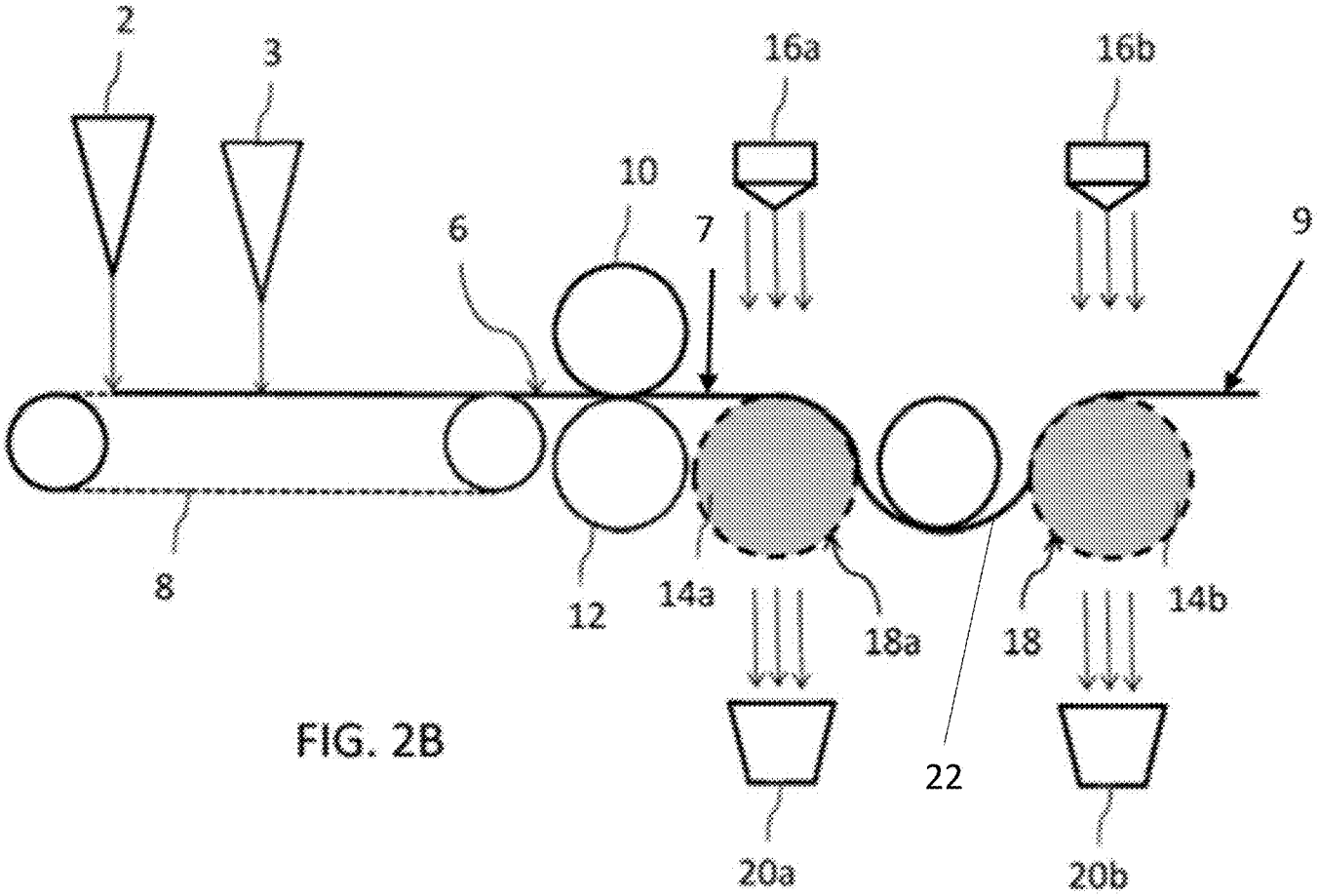

$J$ = Water pressure, bar $G$ = Jet Strip Hole diameter, micron $I$ = Holes/$m$ of the jet strip $L$ = Nonwoven width, $m$ $F$ = Nonwoven mass flow (i.e., throughput of nonwoven web, calculated based on lines speed, product width and basis weight), kg/$hr$ Preferred exemplary embodiments of the present invention involve the use of a relatively large amount of water injectors. Without being bound by theory, this allows for use of high line speeds without having to increase water pressure. FIGS. 2A and 2B illustrate exemplary embodiments of the invention employing one or plural drums for imparting patterns in a nonwoven fabric. Like elements are labeled with the same reference numerals as those in FIG. 1

Without being bound by theory, it is believed that precursor nonwoven web properties have a strong influence on final fabric features. In this regard, the hydro-patterned fabric in accordance with exemplary embodiments of the present invention is subjectively pleasing in terms of both visual appearance and tactile feel. The inventive process results in a nonwoven web in which the pattern of bonding impressions on the precursor is accentuated and, even without 3D shaping during the hydraulic treatment step, the final nonwoven product might appear to have a 3D pattern. The combination of suitable precursor patterns highlights the 3D effect and provides further advantages such as, for example, improved tactile properties, or larger thickness while maintaining the same basis weight, which in turn provides performance advantages such as, for example, space for controlled liquid management. At the same time, the thermo-bonded, preferably fully bonded precursor provides necessary mechanical properties of the fabric, such as, for example strength, elongation, or abrasion resistance.

The precursor nonwoven web is exposed to hydro-patterning as discussed herein, providing a desired improvement in pattern visual effect, thickness and softness. Also, the drop of mechanical properties, such as, for example, tensile strength, elongation or abrasion resistance is limited. Important features of the precursor nonwoven according to exemplary embodiments of the present invention are described below.

Conventional art, especially U.S. Pat. No. 7,858,544 and its family describe advantages of using oval and so-called anisotropic patterns of bonding impressions (fusion bonds) limited only by total bond area percentage. Surprisingly, it has been found that patterns of bonding impressions that are not anisotropic are very suitable for the hydro-patterning process disclosed herein and provide the desired visual effect.

In an exemplary embodiment, the precursor nonwoven web may have a Bond Area Percentage preferably at least 5%, preferably at least 10%. Without being bound by theory, it is believed that lower Bond Area Percentages do not provide enough stability to the batt and the fabric is unstable during the hydro-patterning process.

In an exemplary embodiment, the precursor nonwoven web may have a maximum Bond Area Percentage of preferably 30%, preferably 25%. Without being bound by theory, it is believed that higher Bond Area Percentages present too large an area of fused bonding impressions and there is not enough space for the water streams to interact with fabric filaments without damaging the bonding impressions, thereby causing a large drop in mechanical properties of the final fabric compared to the precursor.

In addition to Bond Area Percentage, the size and shape of, and the distance between bonding impressions, are important parameters in the overall hydro-patterning process.

In general bonding impressions can be divided into two groups: "small bonding impressions" with bond impression area below 1 $mm^2$; and "large bonding impressions" with bond impression area equal or over 1 $mm^2$. Size of the bonding impression is in general provided by the calender producer and can also be measured on the precursor or estimated from the hydro-patterned fabric. When measured from the fabric, the same methodology as that used to determine Bond Percentage Area is used, with at least 20 single bonding impressions of each type being measured and the arithmetic mean calculated.

Small bonding impressions are typically arranged in a regular pattern with rows and columns or make up lines or various other shapes. For the purposes of the present disclosure, adjacent small bonding impressions are considered individual bonding impressions when the smallest distance between the adjacent bonding impressions is at least 0.3 mm, preferably at least 0.4 mm, most preferred at least 0.5 mm.

In accordance with exemplary embodiments of the present invention, the number of small bonding impressions per 1 $cm^2$ of the fabric is at least 20 bonding impressions per one square centimeter, preferably at least 30 bonding impressions per one square centimeter, more preferably at least 40 bonding impressions per one square centimeter, more preferably at least 50 bonding impressions per one square centimeter, even more preferably at least 60 bonding impressions per one square centimeter.

Large bonding impressions can also be arranged in a regular pattern with rows and columns, and are large enough so that their shapes might be clearly visible to the naked eye in the thermo-bonded fabric. A bonding patten might be formed from one shape repeated over and over or might be made up of a combination of one or more large bonding shapes.

Large and small bonding impressions can be also combined, as described in, for example, European Patent No. EP3452652.

Examples of various patterns formed of small bonding impression, formed from large boning impressions and formed by a combination of small and large bonding impressions are presented in the figures and described below.

Without being bound by theory, it is believed that the presence of small bonding impressions is advantageous in the hydro-patterning process because small bonding impression have a small area and are also slightly movable within the fabric, as there is a lower amount of filaments fused together within each impression. When the water stream is about to hit the small bonding impression, the bonding impression might move a bit in any direction and might also tilt in the z-direction, thereby avoiding the entire energy from the water stream and limiting damage that might result. Without being bound by theory, it is believed that presence of small bonding impressions decreases the drop of fabric mechanical properties during the hydro-patterning process.

Large bonding impressions that include carefully selected impression shapes also have freedom to move/tilt and avoid acceptance of all energy from the water stream, and thus are also suitable for use with exemplary embodiments of the present invention.

Without being bound by theory, it is believed that large bonding impressions having a shape in a form of a line that is straight or shaped or curved, and whose width is constant or irregular, is advantageous for use in the hydro-patterning process according to exemplary embodiments of the invention in that such bonding impressions minimize the drop of fabric mechanical properties during the hydro-patterning process.

In an exemplary embodiment the line shaped large bonding impression is in a form of continuous line with a line width (W) of maximum 0.6 mm, preferably maximum 0.5 mm, most preferred maximum 0.4 mm. The line shaped large bonding impressions are preferably not continuous with one another. In an exemplary embodiment the line shaped large bonding impression has a maximum line length (L) of 30 mm, preferably 25 mm, more preferably 20 mm.

Figure 3B:
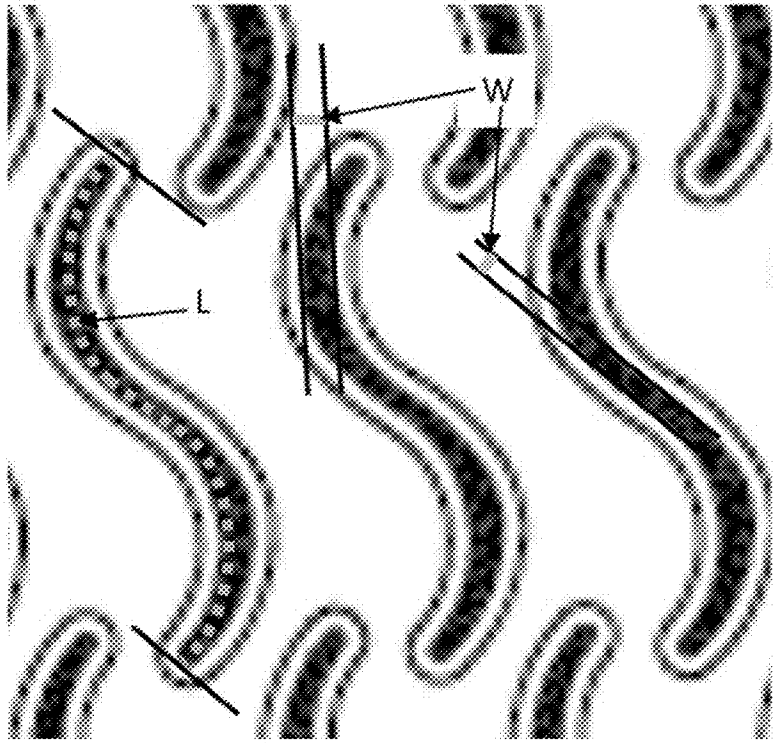
FIGS. 3A, 3B, 3C and 3D show bonding patterns useable with methods for forming a hydro-patterned nonwoven web according to an exemplary embodiment of the present invention.
Figure 3A:
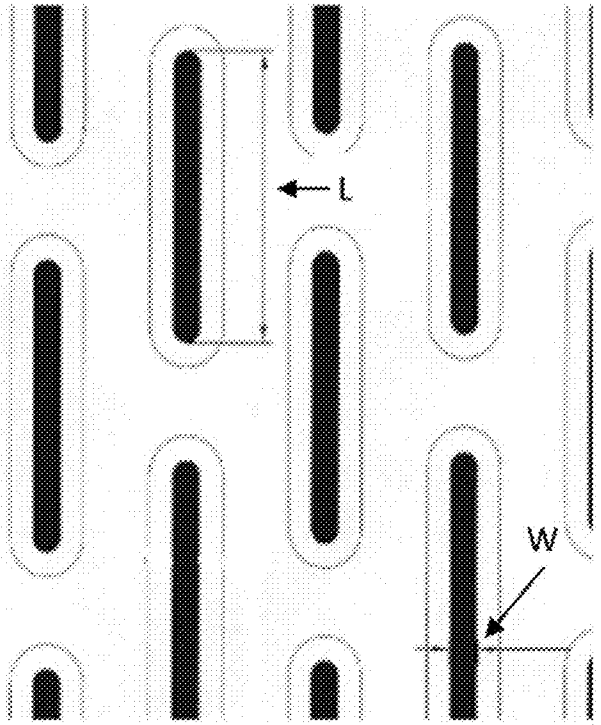
Figure 3C:
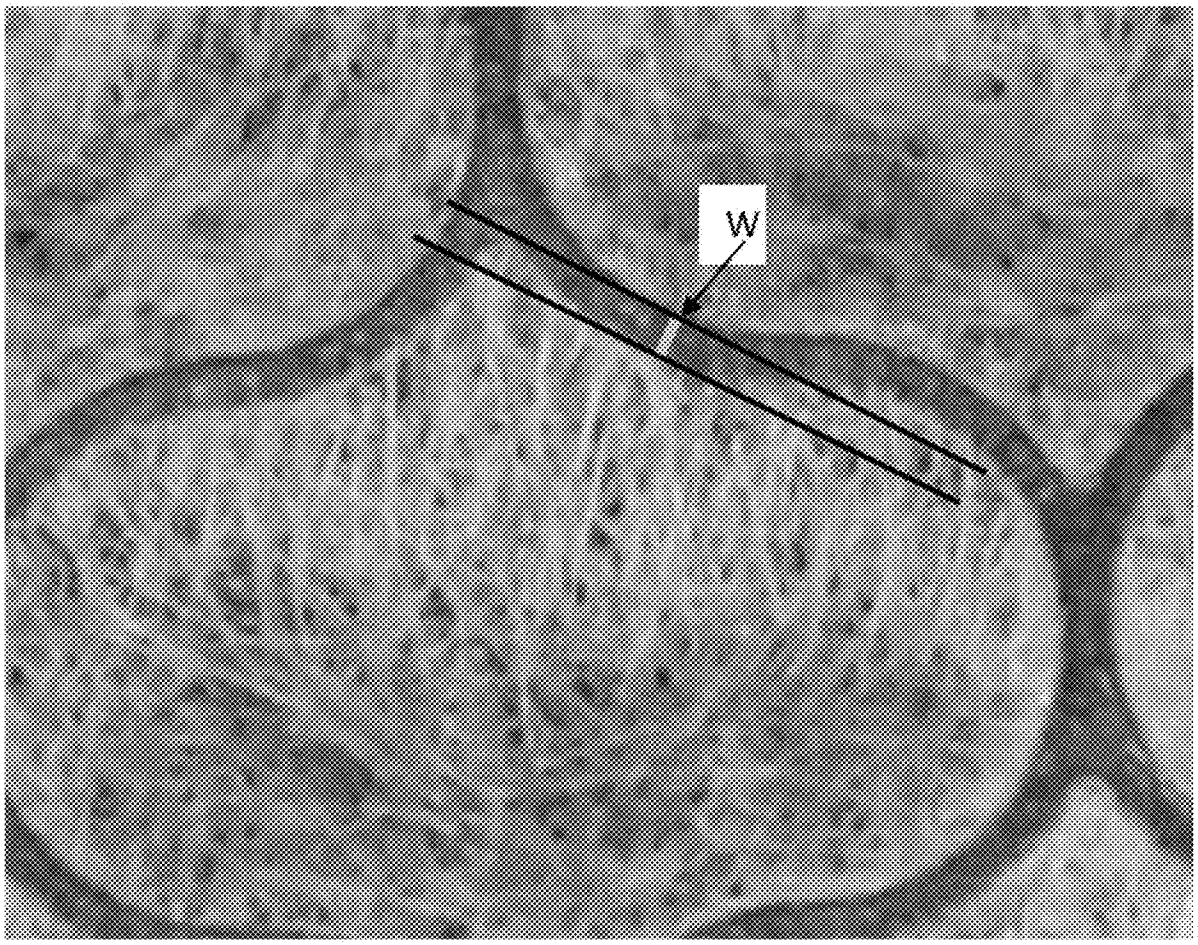
Figure 3D:
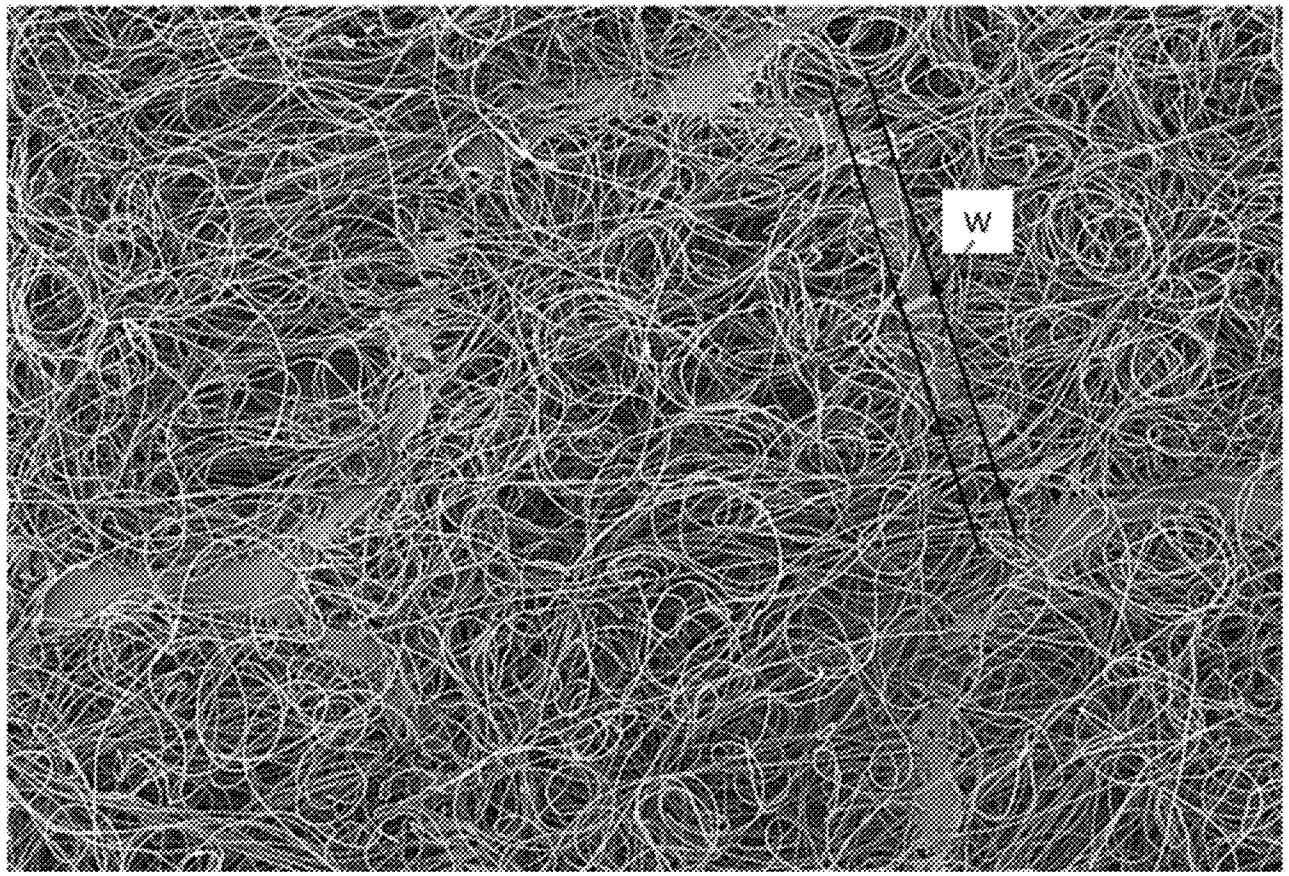

FIGS. 3A, 3B, 3C and 3D show various line shaped bonding patterns that are preferred for use in accordance with exemplary embodiments of the present invention. FIG. 3A shows a pattern formed of straight lines with constant width, where the straight lines that make up each individual impression are not continuous with one another. FIG. 3B shows a pattern formed of curved lines with constant width, where the curved lines that make up each individual impression are not continuous with one another. FIGS. 3C and 3D show a pattern formed of curved lines with irregular width, where the curved lines are continuous with one another. FIG. 3C shows the continuous pattern on the precursor web, while FIG. 3D shows the continuous pattern on the hydro-patterned fabric.

For the purposes of the present disclosure, the length L of bonding impressions is measured by identifying a shape length line intersecting the perimeter of the bonding shape at points of intersection that are the greatest distance apart that may be identified on the perimeter, i.e., the distance between the two farthest-most points on the perimeter. The bonding shape has a width W which is measured by identifying respective shape width lines which are parallel to shape length line and tangent to the shape perimeter at one or more outermost points that are most distant from shape length line on either side of it, as reflected in FIGS. 3A and 3B. It will be appreciated that, for some shapes (e.g., a semicircle), one of shape width lines may be coincident/colinear with shape length line. The width W is the distance between shape width lines.

Without being bound by theory, it is believed that line shaped large bonding impressions are more successful in avoiding mechanical damage during the hydro-patterning process when they are oriented substantially in the MD direction. The line shaped bonding impressions might be angled relative to the MD direction so that a shape tilt angle $\alpha T$ may be expressed as the smaller angle formed by the intersection of an axis along the machine direction and the shape length line. The shape tilt angle $\alpha T$ should not exceed 50 degrees, more preferably not exceed 40 degrees, and still more preferably not exceed 30 degrees, most preferably not exceed 20 degrees.

Without being bound by theory, it is believed that line shaped large bonding impressions are more successful in avoiding mechanical damage during the hydro-patterning process when the bonding impression shape comprises at least one convex portion along its perimeter. For example, a line shaped large bonding impression may have a convex portion along its perimeter so as to present a C shape, circle or J shape. For example, a line shaped large bonding impression may have two convex portions to present an S shape, B shape or 8 shape, etc.

Distance between bonding impressions, or in other words area of unbonded filaments among the bonding impressions, provides the space where energy from water streams can be absorbed, resulting in increased fabric thickness and softness as compared to the precursor web. During the fabric formation process, free filaments are laid down on the belt to form a batt and then defined areas of the batt are fused to form bonding impressions. One filament typically extends through many bonding impressions and, importantly, the path of the filament is not straight, but instead forms various loops and turns in all three dimensions, although mostly in MD-CD plane. The water stream energy of the subsequent hydro-patterning process moves the free parts of the filaments and enhances their path in the third dimension (through the thickness of the fabric). This results in increase of the fabric thickness. Hydro-patterning also smooths or loosens harder edges of bonding impressions (created by protrusion on the calender roll and oriented along the surface of the fabric) and improves tactile properties of the fabric. Accordingly, hydro-patterned fabrics in accordance with exemplary embodiments of the invention are very comfortable to touch and pleasant to wear on the skin. Further, changes in orientation of free portions of the filaments results in changes in the visual effect of the fabric. For example, such changes might highlight the pattern or parts of the pattern and might also evoke 3D perception, even in planar fabric. To improve this desired effect, some shapes and sizes of areas of unbonded filaments are preferred.

Without being bound by theory, it is believed that with increasing size of free filament area undisturbed by bonding imprints, there is an increase in desired effects of the hydro-patterning process. In this regard, size of the free filament area within a bonding pattern may be measured by defining the largest imaginary circle C that encompasses a free filament area and which has a perimeter that passes through a single point on the perimeter of each of at least two bonding impressions within the pattern, where the size of the free filament area is defined as the radius of the imaginary circle. FIGS. 4A, 5, 6A, 7A, 7B, 8A, 9, 10A, and 10B show circle C as defined within different bonding patterns in accordance with exemplary embodiments of the present invention.

In an exemplary embodiment, the circle C has a radius at least 0.5 mm, preferably at least 1 mm, more preferably at least 1.5 mm, even more preferably at least 2 mm.

Without being bound by theory, it is believed that bonding impressions that are not in the form of a line provide advantages when combined with small impressions and/or free filaments areas. Such bonding impressions may have non-linear shapes, such as, for example, circles, ovals, diamonds, squares, rectangle, etc., and do not have a recognizable width W or length L as described above. For the purposes of the present disclosure, non-linear bonding impressions or linear bonding impressions having a width of at least 0.6 mm are called large-bold bonding impressions.

In exemplary embodiments, features of different patterns might be combined to provide a synergistic effect on the advantages provided by the hydro-patterning process. Features of various patterns useable with the process in accordance with exemplary embodiments of the present invention are provided in Table 1.

For example, standard Pattern P1 (FIGS. 4A and 4B) is made up of small bonding impressions arranged in rows and columns forming a regular pattern. This pattern provides circle C having a radius smaller than 0.5 mm and does not contain large bonding impressions. It can be expected that this standard pattern would express a relatively small drop of mechanical properties but will not provide a large increase in thickness.

Figure 5:
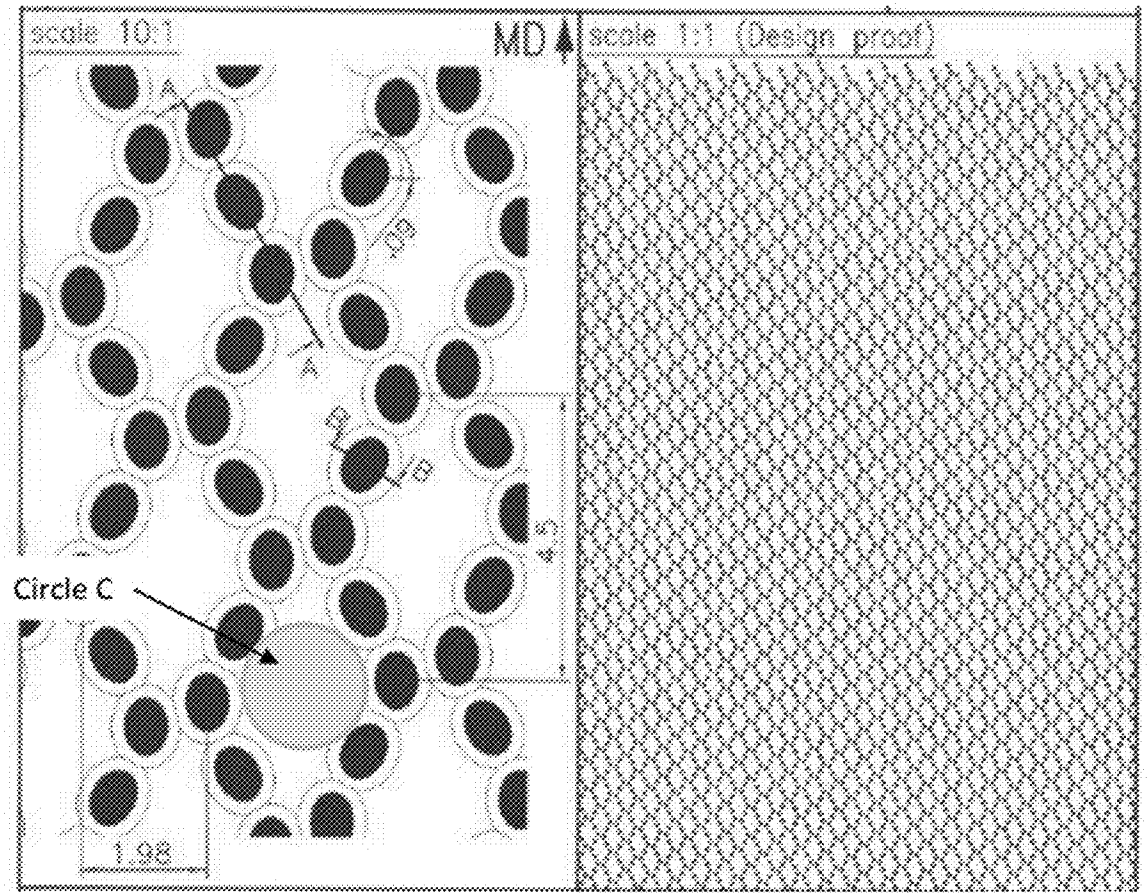
FIG. 5 shows a bonding pattern useable with methods for forming a hydro-patterned nonwoven web according to an exemplary embodiment of the present invention.

In exemplary embodiments, small bonding impressions may be arranged around free filaments areas to provide desired advantages. For example, small bonding impressions might be arranged directly adjacent to one another to form a line, similar to stone pathways on a lawn. Such a pattern, designated P6, is shown in FIG. 5. In this case, the hydro-treatment would result in only a small drop of mechanical properties and a large increase in fabric thickness.

In an exemplary embodiment, the pattern of bonding impressions is made up of small bonding impressions with bonding area below 1 $mm^2$ with a smallest distance between adjacent bonding impressions being at least 0.3 mm, preferably at least 0.4 mm, most preferred at least 0.5 mm, where the circle C has a radius of at least 1 mm, preferably at least 2 mm, more preferably at least 3 mm, even more preferably at least 4 mm.

Figure 6A:
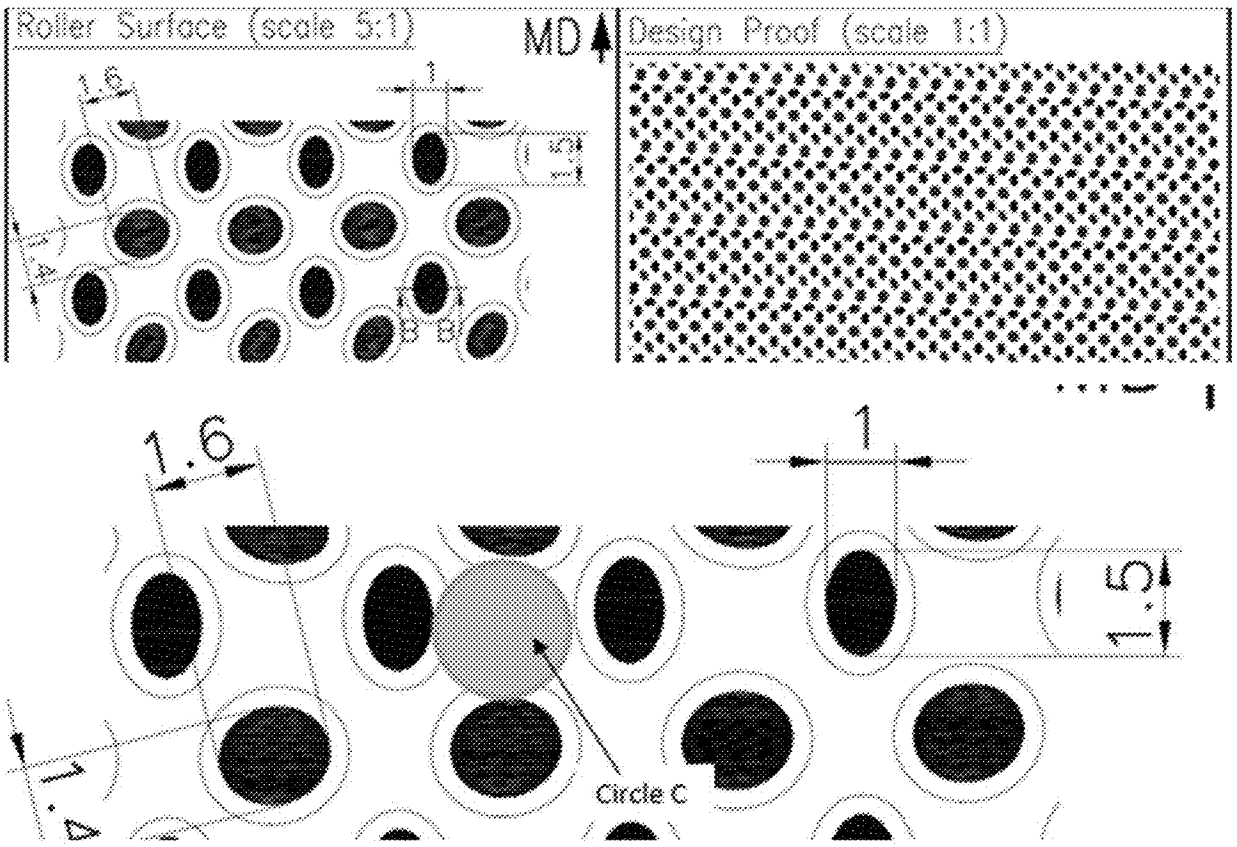
FIG. 6A shows a bonding pattern useable with methods for forming a hydro-patterned nonwoven web according to an exemplary embodiment of the present invention.
Figure 6B:
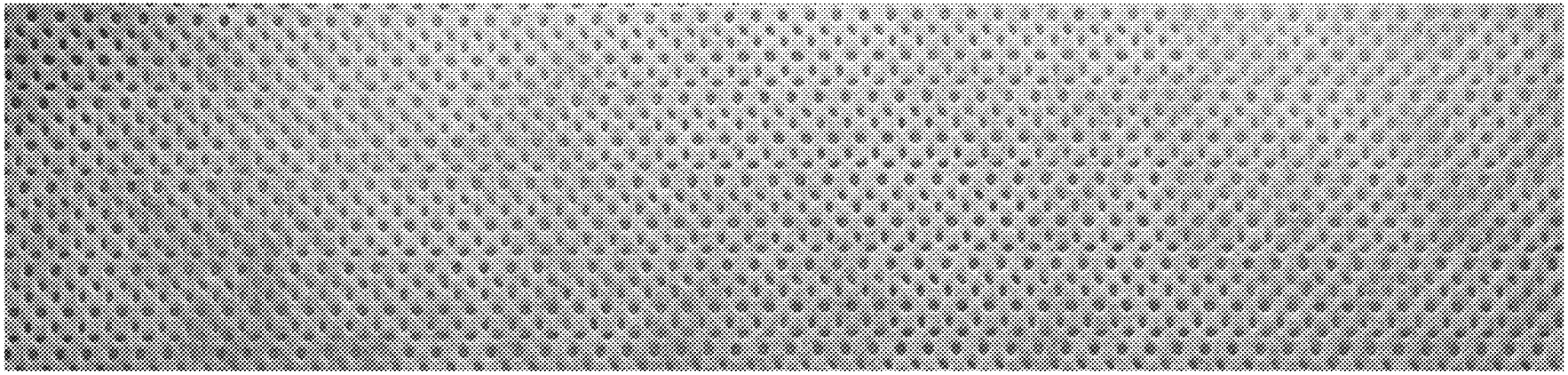
FIG. 6B shows the bonding pattern of 6A on a precursor web according to an exemplary embodiment of the present invention.

In exemplary embodiments, large bonding impressions may be arranged around free filaments areas to provide desired advantages. For example, large bonding impressions in the shape of ovals might be arranged so that free filaments areas separate the large bonding impressions from one another. Such a pattern, designated P2, is shown in FIGS. 6A and 6B. In this case, the large bonding impressions would result in a larger drop in mechanical properties, but the free filaments areas would provide an increase in fabric thickness.

In an exemplary embodiment, the pattern of bonding impressions is made up of large bonding impressions with a bonding area of at least 1 $mm^2$, where the circle C has a radius of at least 0.5 mm, preferably at least 1.0 mm, more preferably at least 1.5 mm, even more preferably at least 2.0 mm.

In an exemplary embodiment, the pattern of bonding impressions is made up of large-bold bonding impressions with a bonding area of at least 1 $mm^2$, where the circle C has a radius of at least 0.5 mm, preferably at least 2.0 mm, more preferably at least 1.5 mm, even more preferably at least 2.0 mm.

Figure 7A:
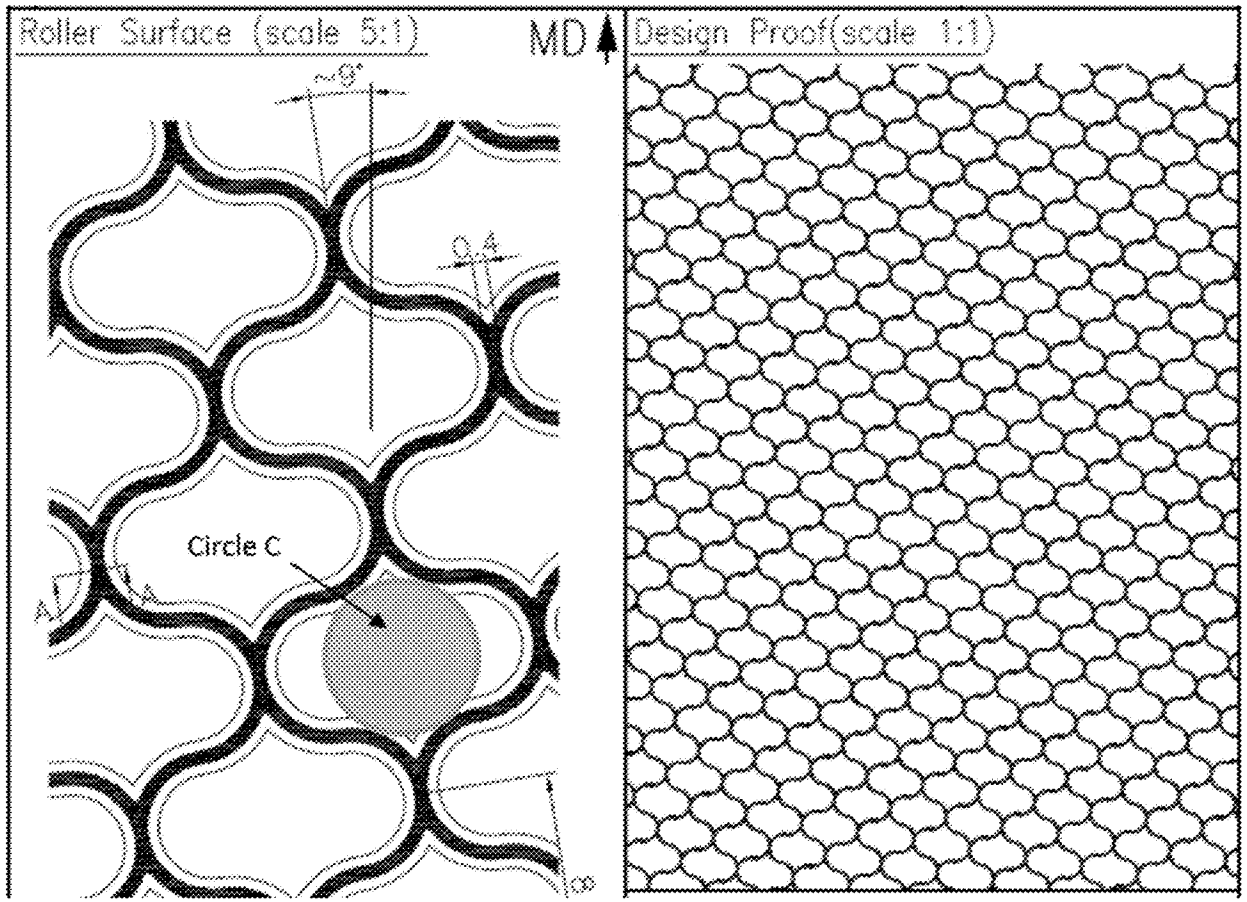
FIG. 7A shows a bonding pattern useable with methods for forming a hydro-patterned nonwoven web according to an exemplary embodiment of the present invention.
Figure 7B:
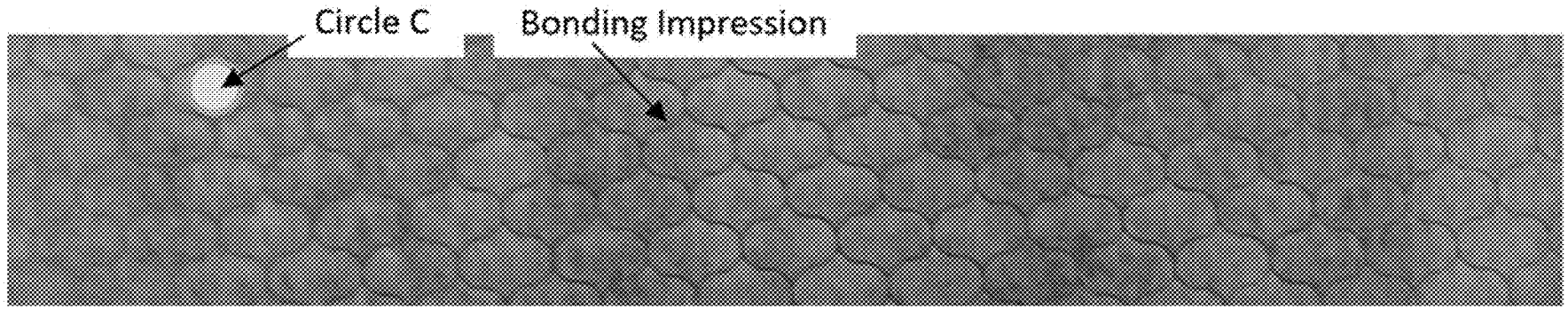
FIG. 7B shows the bonding pattern of 7A on a precursor web according to an exemplary embodiment of the present invention.

In exemplary embodiments, line shaped large bonding impressions may be arranged around free filaments areas to provide desired advantages. For example, line shaped large bonding impression might be made up of a series of curved lines that might for example cross one another to form free filament areas. Such a pattern, designated P7, is shown in FIGS. 7A and 7B. In this case, the line shaped large bonding impressions would prevent a large drop in mechanical properties and the free filaments areas would provide an increase in fabric thickness.

In an exemplary embodiment, the pattern of bonding impressions is made up of line shaped large bonding impressions with a maximum line width (W) of 0.6 mm, preferably 0.5 mm, most preferably 0.4 mm, where the circle C has a radius of at least 1 mm, preferably at least 2 mm, more preferably at least 3 mm, even more preferably at least 4 mm. The perimeter of the line shaped bonding impression preferably includes at least one convex portion.

Figure 8A:
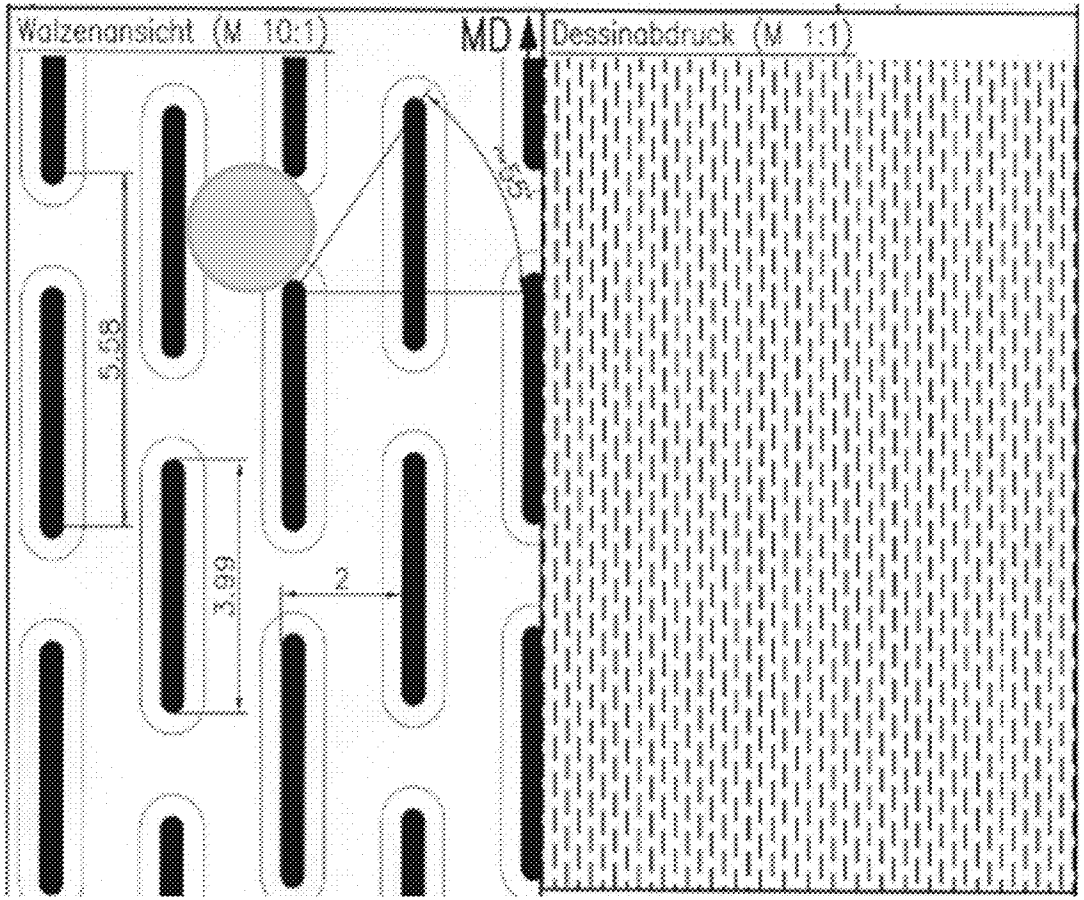
FIG. 8A shows a bonding pattern useable with methods for forming a hydro-patterned nonwoven web according to an exemplary embodiment of the present invention.
Figure 8B:
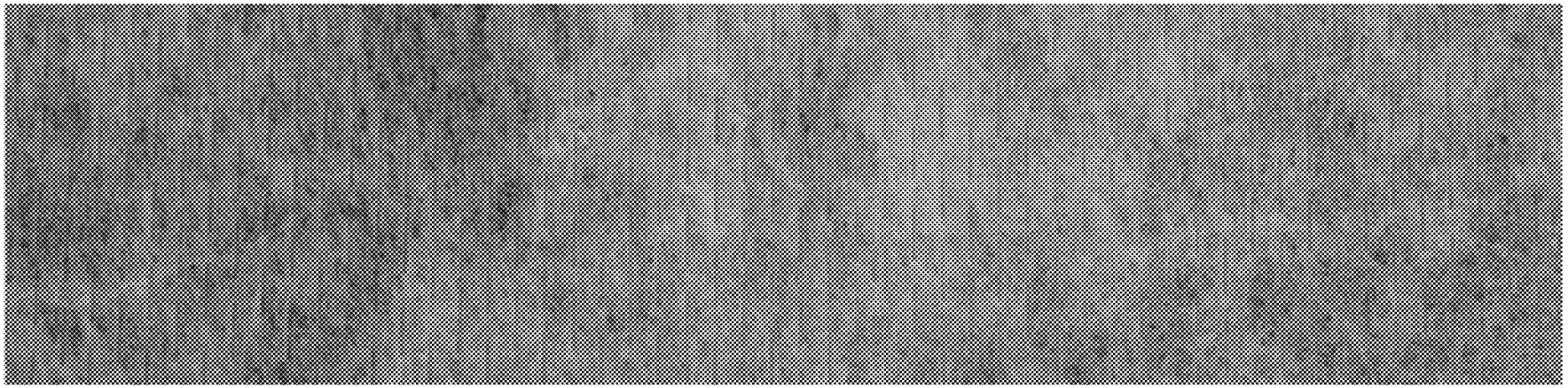
FIG. 8B shows the bonding pattern of 8A on a precursor web according to an exemplary embodiment of the present invention.

In exemplary embodiments, discontinuous line shaped large bonding impression may be arranged around free filaments areas to provide desired advantages. For example, the line shaped large bonding impression might have an I shape or an S shape, where the bonding impressions are arranged in rows and columns. Such a pattern, designated P3, is shown in FIGS. 8A and 8B. In this case, the line shaped discontinuous large bonding impressions would prevent a large drop in mechanical properties and the free filaments areas would provide an increase in fabric thickness.

In an exemplary embodiment, the pattern of bonding impressions is made up of line shaped large bonding impressions with a maximum line width (W) of 0.6 mm, preferably 0.5 mm, most preferably 0.4 mm and the line shaped large bonding impressions have a maximum length (L) of 30 mm, preferably 25 mm, more preferably 20 mm, where the circle C has a radius of at least 0.5 mm, preferably at least 1.0 mm, more preferably at least 1.5 mm, even more preferably at least 2.0 mm. The perimeter of the line shaped bonding impression preferably includes at least one convex portion.

Figure 9:
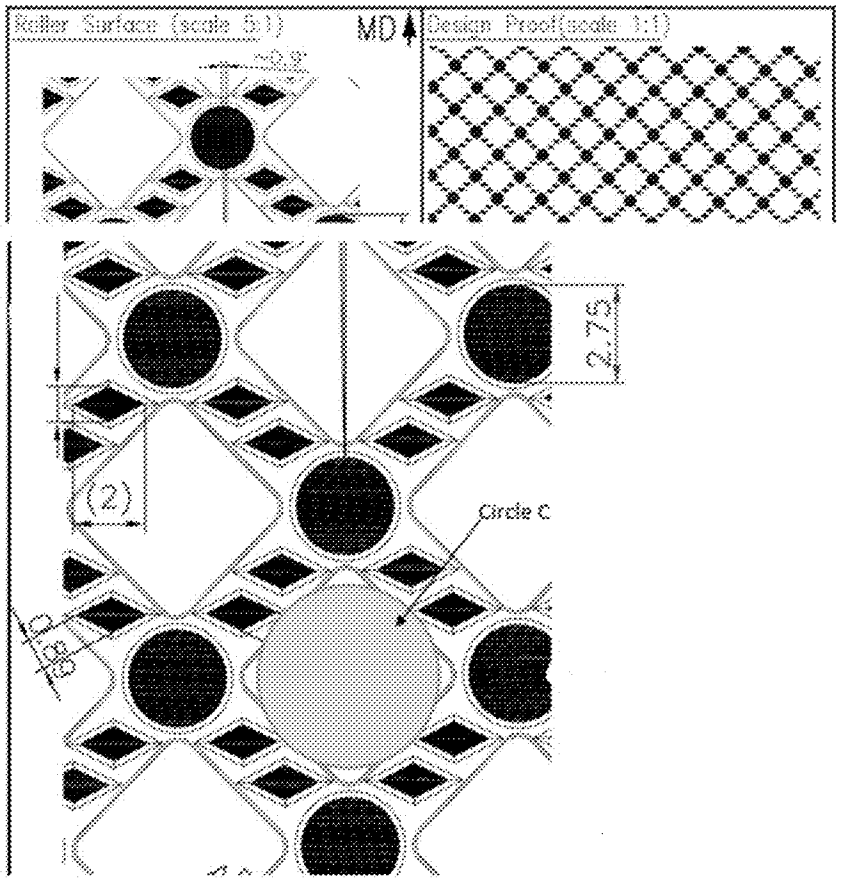
FIG. 9 shows a bonding pattern useable with methods for forming a hydro-patterned nonwoven web according to an exemplary embodiment of the present invention.

In exemplary embodiments, large bonding impression and small bonding impressions may be arranged around free filaments areas the provide desired advantages. For example, large-bold bonding impressions having a circle shape may be placed relatively far from one another, with small bonding impressions forming connecting lines between some of the large-bold bonding impressions, thereby forming free filaments areas among the large-bold bonding impressions and the small bonding impressions. Such a pattern, designed P9, is shown in FIG. 9. In this case, the synergistic effect of the described combination provides a small drop in mechanical properties along with large increase in thickness and visual effect. For example, the hydro-patterning process results in visual highlighting of the large bonding impressions and visual suppression of the small bonding impressions, thereby providing an overall soft fluffy-like cushion visual effect, along with good mechanical properties and abrasion rating.

In an exemplary embodiment, the pattern of bonding impressions is made up of large bonding impressions with a bonding area of at least 1 $mm^2$, small bonding impressions with a bonding area less than 1 $mm^2$, with the circle C having a radius of at least 1 mm, preferably at least 2 mm, more preferably at least 3 mm, even more preferably at least 4 mm.

Figure 10A:
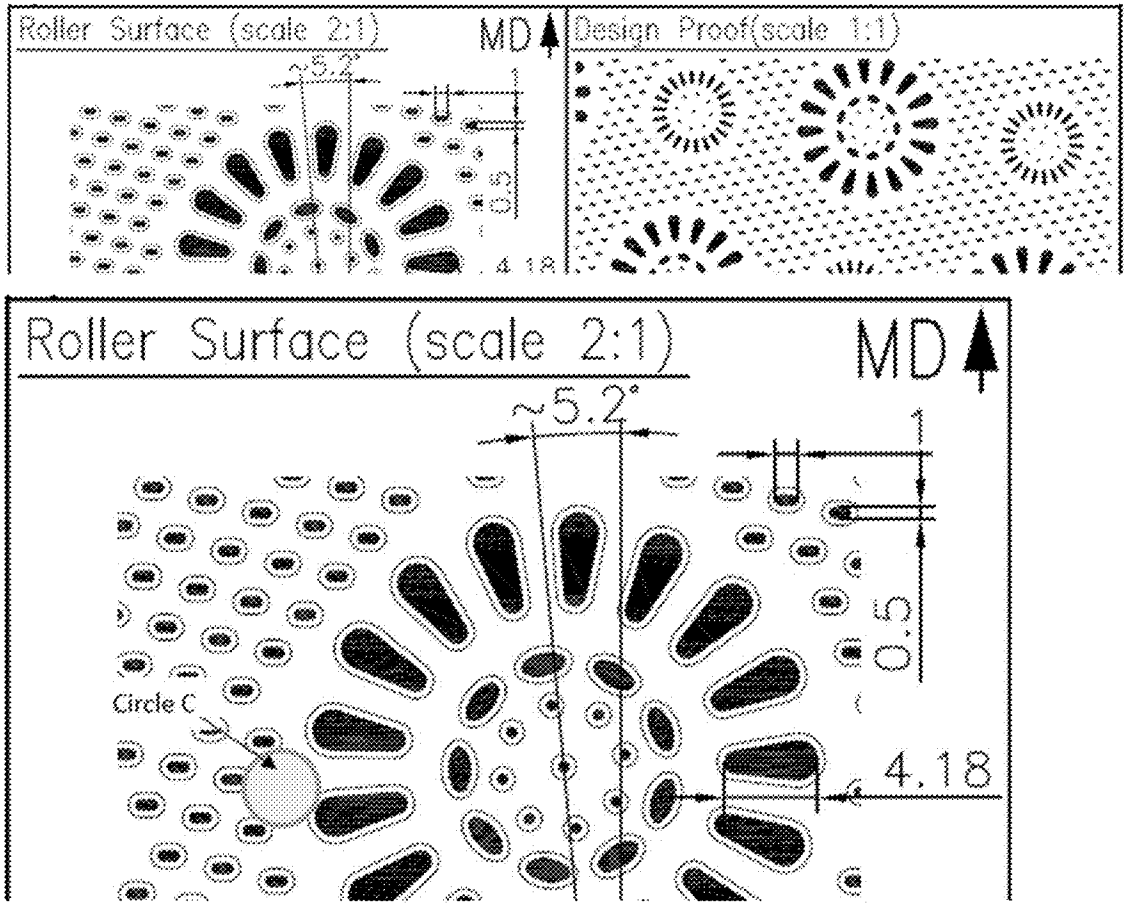
FIG. 10A shows a bonding pattern useable with methods for forming a hydro-patterned nonwoven web according to an exemplary embodiment of the present invention.
Figure 10B:
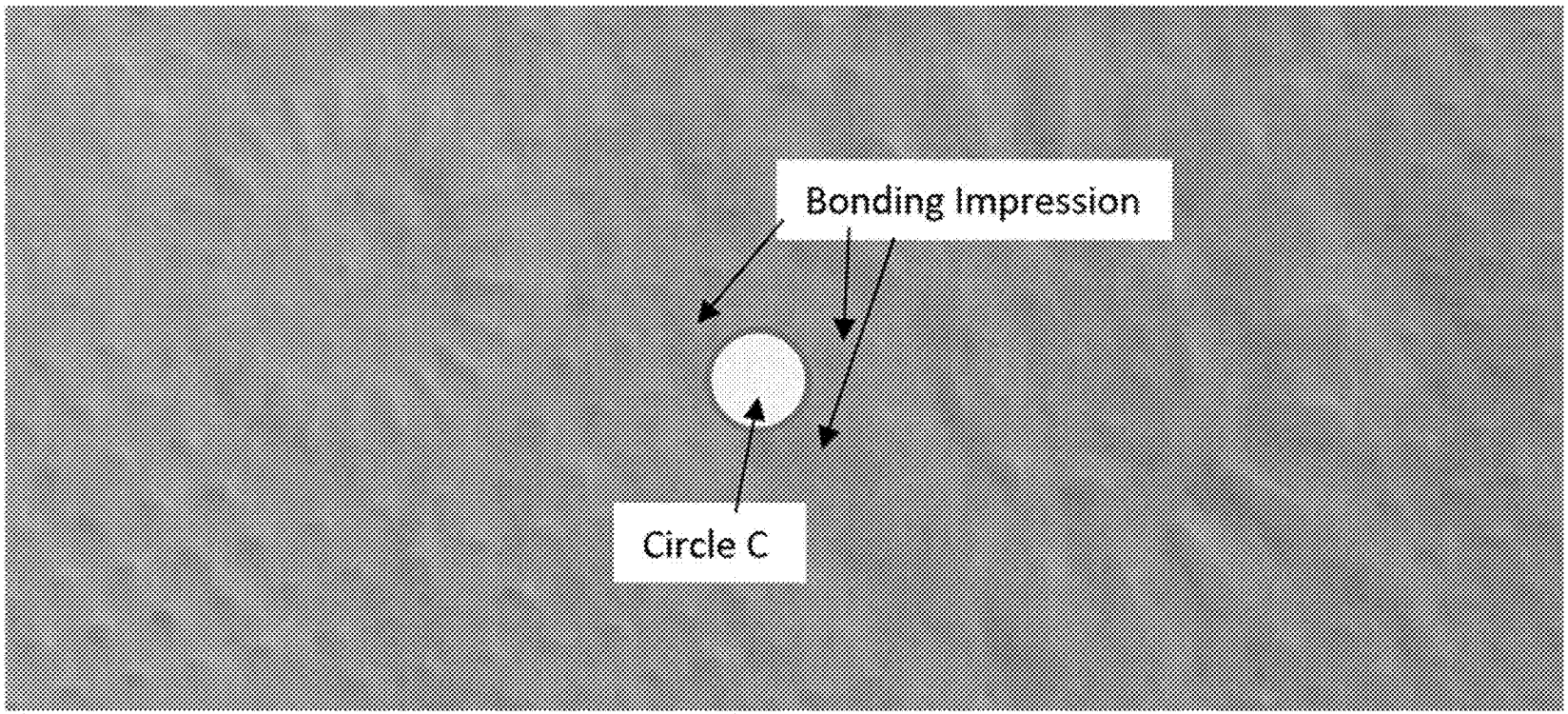
FIG. 10B shows the bonding pattern of 10A on a precursor web according to an exemplary embodiment of the present invention.

In exemplary embodiments, discontinuous line shaped large bonding impressions and small bonding impressions may be arranged around free filaments areas. For example, the discontinues line shaped large bonding impressions might be used to form visually primary patterns (for example, patterns of sun-like shapes) that are spaced relatively far from one another, with a variety of small bonding impressions arranged among the visually primary patterns. Such a pattern, designed P8, is shown in FIGS. 10A and 10B. In this case, the synergistic effect of the described combination would result in a small drop of mechanical properties together with a large increase in thickness and visual effect. For example, the hydro-patterning process results in visual highlighting of the visually primary patterns and visual suppression of the small bonding, thereby providing an overall soft fluffy-like visual effect, along with good mechanical properties and abrasion rating.

In an exemplary embodiment, the pattern of bonding impressions is made up of line shaped large bonding impressions with a maximum line width (W) of 0.6 mm, preferably 0.5 mm, most preferably 0.4 mm and the line shaped large bonding impressions have a maximum length (L) of 30 mm, preferably 25 mm, more preferably 20 mm and small bonding impressions with a bonding area below 1 $mm^2$, with the circle C having a radius of at least 1 mm, preferably at least 2 mm, more preferably at least 3 mm, even more preferably at least 4 mm. The perimeter of the line shaped bonding impressions preferably includes at least one convex portion.

It should be appreciated that the present invention is not limited to the patterns described herein, and exemplary embodiments may include various other combinations of patterns to achieve desired advantages of the hydro-patterning process.

Without being bound by theory, it is believed Equation 1 may be used to predict a suitable thermo-bonding pattern for the hydro-patterning process.

$$K = \frac{\left[\begin{array}{c}\text{number of bonding}\\ \text{impressions}\\ \text{per 1 cm2}\\ \left(\frac{BI}{\text{cm2}}\right)\end{array}\right] \times 100}{\left[\begin{array}{c}\text{Bond Area}\\ \text{Percentage}\\ (\%)\end{array}\right] \times \left[\begin{array}{c}\text{area of}\\ \text{smallest } BI \text{ in}\\ \text{the pattern}\\ \text{(mm2)}\end{array}\right] \times \left[\begin{array}{c}\text{area of}\\ \text{the largest possible}\\ \text{circle } C\\ \text{(mm2)}\end{array}\right]} \quad (1)$$

Where $$\left[\begin{array}{c}\text{area of}\\ \text{the largest possible}\\ \text{circle } C\\ \text{(mm2)}\end{array}\right] = \pi \times \left[\begin{array}{c}\text{radius of}\\ \text{the largest possible}\\ \text{circle } C\\ \text{(mm)}\end{array}\right]^2$$

$K$=[(number of bonding impressions per 1 $cm^2$) *100]/[(Bond Area Percentage in %)*(Smallest bonding impression area in the pattern in $mm^2$) *(area of the largest possible circle $C$ ($mm^2$)].

Equation 1 is not applicable to patterns containing continuous line-shaped large bonding impressions.

Without being bound by theory, it is believed that a K value larger than 5 is desirable for the hydro-patterning process. When the K value exceeds 20, the fabric should express an increase in thickness during the hydro-patterning process, and when the K value exceeds 50, the hydro-patterned fabric should express excellent improvement in visual properties without significant drop in mechanical properties. It should be noted that values of K greater than a certain threshold, such as, for example, 100, may be equal or similar in quality, so that, for example, a K value of 200 is not necessarily better than a K value of 150.

In an exemplary embodiment, the K value is at least 5, preferably at least 10, more preferably at least 15, and even more preferably at least 25, most preferably at least 50. Properties of bonding patterns useable with the hydro-patterning process according to exemplary embodiments of the present invention are provided in Table 1 in FIG. 11.

Hydro-patterned fabric according to exemplary embodiments of the present invention made by the processes described herein are soft with good tactile properties and pleasant to wear on the skin.

In accordance with an exemplary embodiment, the tensile strength drop in the CD direction is lower than 50%, preferably lower than 40%, even more preferably than 30%, most preferably lower than 20%.

In accordance with an exemplary embodiment, the tensile strength drop in the MD direction is lower than 50%, preferably lower than 40%, even more preferably lower than 30%, most preferably lower than 20%.

In accordance with an exemplary embodiment, the hydro-patterned nonwoven web has a basis weight of 10 gsm to 60 gsm, preferably 15 gsm to 45 gsm, most preferred 20 gsm to 35 gsm.

In accordance with an exemplary embodiment, the hydro-patterned nonwoven web has a caliper of at least 10 microns/gsm of fabric, preferably of at least 11 microns/gsm of fabric, most preferred of at least 12 microns/gsm of fabric In accordance with an exemplary embodiment, the hydro-patterned nonwoven web has a MD tensile strength of at least 4 N/cm.

In accordance with an exemplary embodiment, the hydro-patterned nonwoven web has a CD tensile strength of at least 2 N/cm.

In accordance with an exemplary embodiment, the hydro-pattern nonwoven web provides a high level of softness. Softness itself is a very general term involving many various perceptions, some of which might be expressed by measurements such as Handle-O-Meter, Cantilever test, compressibility, thickness, coefficient of friction and/or many other methodologies. It should be noted that each test provides only limited information regarding softness and might be suitable for only some applications or some ranges of basis weight, polymer compositions, etc.

The nonwoven web may be incorporated into a nonwoven laminate. The nonwoven laminate may include additional layers of continuous fibers such as spunbond fibers and meltblown fibers and may include composite nonwovens such as spunbond-meltblown-spunbond laminates. The nonwoven laminate may also include short fibers such as staple fibers or may include pulp fibers. These short fibers may be in the form of a consolidated web such as carded web or tissue sheet or may be initially unconsolidated. The nonwoven laminate may also include superabsorbent material, either in particulate form or in a fiberized form. The laminate may be formed through conventional means, including but not limited to thermal bonding, ultrasonic bonding, chemical bonding, adhesive bonding and/or hydroentanglement. In accordance with an exemplary embodiment of the invention, web may form a nonwoven laminate resulting from the one or more processes described above for use as a topsheet, an absorbent core, or a backsheet of an absorbent article.

In other exemplary embodiments of the invention, the screen or roll sleeve may not be flat, but instead might include 3D shapes that is imparted into the fabric. In exemplary embodiments in which a series of drums are used, the 3D screens might be used only on the last drum in the process line to provide the entire shaping of the precursor web. In this regard, the drums before the last drum in the process line are preferably not provided with 3D screens, but instead may be provided with mesh screens. In an exemplary embodiment, drums up to the second to last drum in a line of drums may be used to prepare the precursor fabric for 3D shaping, but again the actual shaping of the precursor fabric preferably occurs at the last drum. It should be appreciated that in other exemplary embodiments of the present invention, the 3D screens may be provided on a belt rather than on a drum.

In exemplary embodiments, the plurality of steps of water injection includes exposing the thermo-bonded nonwoven precursor web 7 to several water injectors (with each water injector having a set of injectors/nozzles), with each water injector applying a higher amount of pressure as compared to an immediately preceding water injector in the machine direction. For example, the water injector 16*c* may apply a higher pressure as compared to the water injector 16*b*, and the water injector 16*b* may apply a higher pressure as compared to the water injector 16*a*. In a specific exemplary embodiment, the water injector 16*b* applies pressure in the amount of at least 80%, preferably 80% to 95% of the pressure applied by water injector 16*c*, and the water injector 16*a* applies pressure in the amount of at least 80%, preferably 80% to 95% of the pressure applied by water injector 16*b*. In embodiments, the water injector 16*a* applies pressure in an amount of at least 64%, preferably 64% to 90% of the pressure applied by water injector 16*c*. providing a desired improvement in pattern visual effect, thickness and softness. Also, the drop of mechanical properties, such as, for example, tensile strength, elongation or abrasion resistance is limited. The relatively low pressure applied by water injector 16*a* results in initial softening of the precursor web, and the higher pressure applied by the water injectors 16*b* and 16*c* provides improvements in thickness and desired visual effect. Without being bound by theory it is believed that the rising gradient in applied pressure helps to preserve individual bond impressions in the softening and thickening stages so as to minimize reduction of mechanical properties, such as, for example, tensile strength, elongation or abrasion resistance.

In embodiments, the plurality of steps of water injection includes exposing the thermo-bonded nonwoven precursor web 7 to two water injectors (with each water injector having a set of injectors/nozzles), with each water injector applying a higher amount of pressure as compared to an immediately preceding water injector in the machine direction. For example, the water injector 16*c* may apply a higher pressure as compared to the water injector 16*b*, and the water injector 16*a* may be excluded.

In embodiments, the plurality of steps of water injection includes exposing the thermo-bonded nonwoven precursor web 7 to four or more water injectors (with each water injector having a set of injectors/nozzles), with each water injector applying a higher amount of pressure as compared to an immediately preceding water injector in the machine direction.

In exemplary embodiments, the hydraulic treatment results in at least partial alteration of the individual bond impressions by application of water pressure. In this regard, application of water pressure may result in removal of at least some of the fully bonded portions of the individual bond impressions so that at least 60%, preferably at least 70%, more preferably 80%, and even more preferably 90% of the fully bonded portions of the individual bond impressions remain after the step of hydraulically imparting.

Figure 16A:
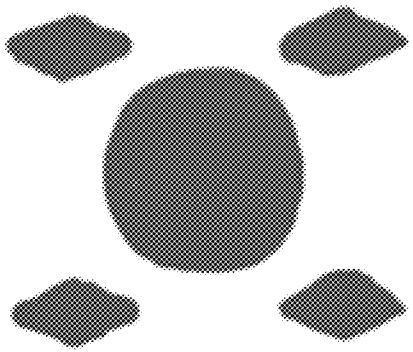
FIGS. 16A and 16B illustrate planar views of a patterned nonwoven web before and after hydraulic treatment in accordance with an exemplary embodiment of the present invention.
Figure 16B:
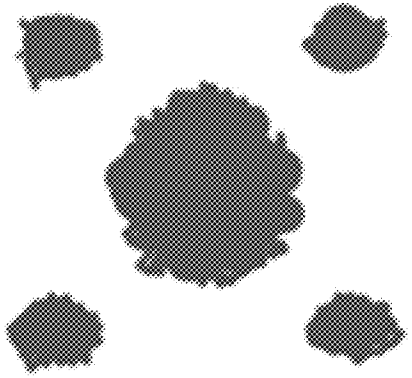

In embodiments, application of water pressure may result in separation of the individual bond impressions into at least two portions. In embodiments, application of water pressure may result in reduction in overall size of the individual bond impressions while maintaining the general profile of the individual bond impressions. For example, as shown in FIGS. 16A and 16B, the alteration may result in reduction in size of the bonding impression while maintaining the general profile of the bonding impression. Without being bound by theory, it is believed that the at least partial alteration of the individual bond impressions results in tactile softness improvement and does not significantly reduce tensile strength and/or abrasion resistance of the final product. Tactile softness is a complex value that is hard to express by simple measurement, as it represents the feeling provided by human fingers. Values measured in this application (caliper, HOM, COF) are partial measurements of tactile softness and their values do not express tactile softness in its complexity.

Figure 15B:
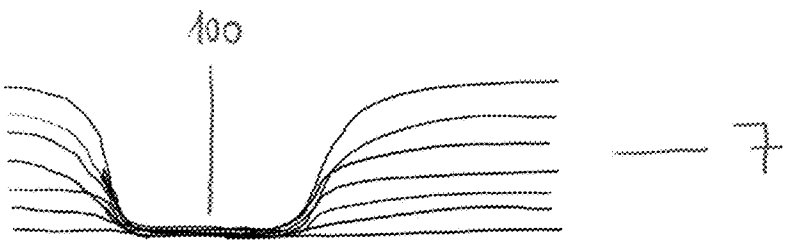
FIGS. 15A-15D shows alteration of an individual bond impression in cross-section resulting from the process of exemplary embodiments of the present invention.
Figure 15C:
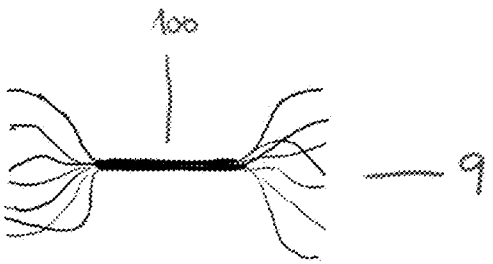
Figure 15A:
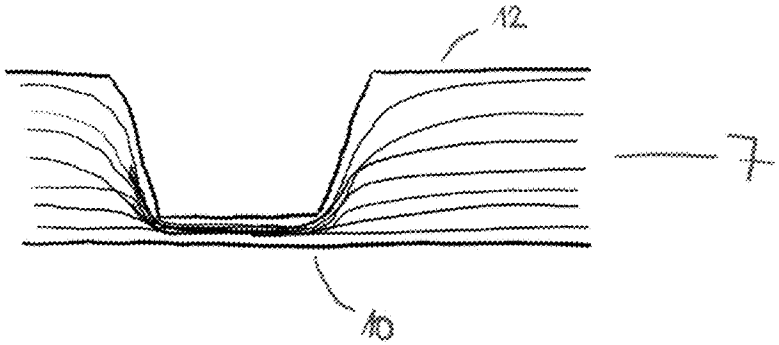
Figure 15E:
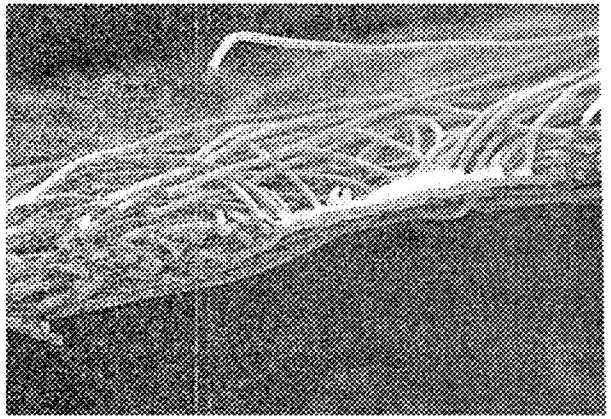
FIGS. 15E and 15F are micrographs showing alteration of an individual bond impression in cross-section resulting from a conventional hydraulic treatment process.
Figure 15F:
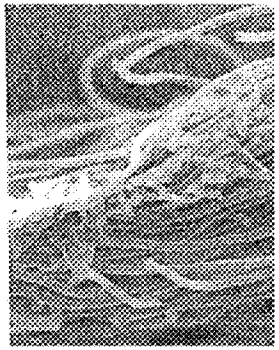
Figure 15D:
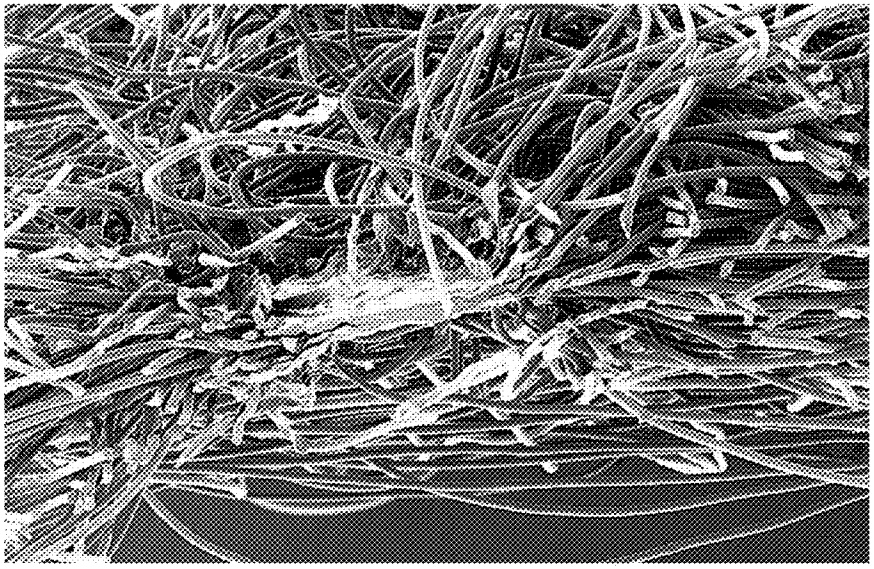

In embodiments, as shown in FIGS. 15A-15F, application of water pressure results in fibers in areas around perimeters of the individual bond impressions being randomly frayed in and out of a major plane of the fully bonded precursor nonwoven web so as to at least partially remove naturally reinforced fibers around the perimeters of the bond impressions to thereby at least partially eliminate the three-dimensionality of the individual bond impressions. More specifically, FIG. 15A is a cross-sectional view showing formation of an individual bond impression with a patterned calender roll 12 and smooth calender 10 with naturally reinforced fibers at the bond impression edge, FIG. 15B is a cross-sectional view of the bonded precursor web with an individual bond impression 100 and naturally reinforced fibers at the bonding impression edge, and FIG. 15C is a cross-sectional view showing the hydraulically treated nonwoven web with an altered individual bond impression where there are no naturally reinforced fibers at the bonding impression edge and also the bonding impression itself is slightly smaller. FIG. 15D is a micrograph of a cross-section of an altered individual bond impression according to an exemplary embodiment of the present invention showing how the hydraulic treatment results in frayed edges around the bond impression with no naturally reinforced fibers around the bond impression perimeter. In contrast, FIGS. 15E and 15F are micrographs of a cross-section of a conventional precursor bonding impression as shown in U.S. Pat. No. 8,410,007, where the naturally reinforced fibers are clearly visible.

Without being bound by theory, it is believed that the randomization of fibers around the perimeter of the individual bond impressions results in a softer final product (tactile softness).

The following Examples and Comparative Examples illustrate advantages of the present invention.

Comparative Example 1 (Precursor Web to Example 1)

A 25 gsm spunmelt type nonwoven batt was produced online in a continuous process from a mixture of polypropylene (type 3155E5 from Exxon) and copolymer (Vistamaxx 6202 from Exxon) in the weight ratio 80:10 and soft enhancing additive based on erucamide (CESA-slip PP 42161 from Avient), where monocomponent polypropylene filaments with a fiber diameter of 13-25 μm were produced and subsequently collected on a moving belt. The batt was produced on REICOFIL 3.1 technology (Reifenhauser Reicofil GmbH & Co. KG, Troisdorf, Germany) from four spunbond beams. The nonwoven batt was fully bonded by a pair of heated rollers, where one roller had raised Pattern P2 (FIGS. 6A, 6B). The temperature of the calender rollers (smooth roller/patterned roller) was 160° C./156° C. and the bonding pressure was 110 N/mm. The resulting nonwoven web was considered not fully bonded and had material properties as shown in Table 2 and 3.

Example 1

The same nonwoven web was formed as described in Comparative Example 1, but with an additional step of hydro-patterning. The hydro-patterning was achieved with two drums with the same setting—a wiremesh screen and two injectors at the drum, each applying a water pressure of 125 bar. Each injector had two rows of holes, with the holes within each row spaced a distance of 0.6 mm from one another (type 2j12). The fabric was moving at a speed of 300 m/min. The resulting nonwoven web had material properties as shown in Tables 2 and 3.

Comparative Example 2 (Precursor Web to Example 2)

A 25 gsm spunmelt type nonwoven batt was produced online in a continuous process from a mixture of polypropylene (type 3155E5 from Exxon) and copolymer (Vistamaxx 6202 from Exxon) in the weight ratio 80:10 and soft enhancing additive based on erucamide (CESA-slip PP 42161 from Avient), where monocomponent polypropylene filaments with a fiber diameter of 13-25 μm were produced and subsequently collected on a moving belt. The batt was produced on REICOFIL 3.1 technology (Reifenhäuser Reicofil GmbH & Co. KG, Troisdorf, Germany) from four spunbond beams. The nonwoven batt was fully bonded by a pair of heated rollers, where one roller has raised Pattern P2 (FIGS. 6A, 6B). The temperature of the calender rollers (smooth roller/patterned roller) was 163° C./161° C. and the bonding pressure was 130 N/mm. The resulting nonwoven web was considered fully bonded and had material properties as shown in Tables 2 and 3.

Example 2

The same nonwoven web was formed as described in Comparative Example 2, but with an additional step of hydro-patterning. The hydro-patterning was achieved with two drums with the same setting—a wiremesh screen and two injectors at the drum, each applying a water pressure of 125 bar. Each injector had two rows of holes, with the holes within each row spaced a distance of 0.6 mm from one another (type 2j12). The fabric was moving at a speed of 300 m/min. The resulting nonwoven web had material properties as shown in Tables 2 and 3.

Comparative Example 3 (Precursor Web to Example 3)

A 25 gsm spunmelt type nonwoven batt was produced online in a continuous process from a mixture of polypropylene (type 3155E5 from Exxon) and copolymer (Vistamaxx 6202 from Exxon) in the weight ratio 75:15 and soft enhancing additive based on erucamide (CESA-slip PP 42161 from Avient), where monocomponent polypropylene filaments with a fiber diameter of 13-25 μm were produced and subsequently collected on a moving belt. The batt was produced on REICOFIL 3.1 technology (Reifenhauser Reicofil GmbH & Co. KG, Troisdorf, Germany) from four spunbond beams. The nonwoven batt was fully bonded by a pair of heated rollers, where one roller has raised Pattern P3 (FIGS. 8A, 8B). The temperature of the calender rollers (smooth roller/patterned roller) was 160° C./163° C. and the bonding pressure was 130 N/mm. The resulting nonwoven web was considered fully bonded and had material properties as shown in Tables 2 and 3.

Example 3

The same nonwoven web was formed as described in Comparative Example 3, but with an additional step of hydro-patterning. The hydro-patterning was achieved with two drums with the same setting—a wiremesh screen and two injectors at the drum, each applying a water pressure of 125 bar. Each injector had two rows of holes, with the holes within each row spaced a distance of 0.6 mm from one another (type 2j12). The fabric was moving at a speed of 300 m/min. The resulting nonwoven web had material properties as shown in Tables 2 and 3.

Comparative Example 4 (Precursor Web to Example 4)

A 25 gsm spunmelt type nonwoven batt was produced online in a continuous process from a mixture of polypropylene (type 3155E5 from Exxon), low molecular weight additive (L-MODU from Idemitsu) and soft enhancing additive based on erucamide (CESA-slip PP 42161 from Avient), where monocomponent polypropylene filaments with a fiber diameter of 13-25 μm were produced and subsequently collected on a moving belt. The batt was produced on REICOFIL 3.1 technology (Reifenhauser Reicofil GmbH & Co. KG, Troisdorf, Germany) from four spunbond beams. The nonwoven batt was fully bonded by a pair of heated rollers, where one roller has raised Pattern P7 (FIGS. 7A, 7B). The temperature of the calender rollers (smooth roller/patterned roller) was 160° C./165° C. and the bonding pressure was 110 N/mm. The resulting nonwoven web was considered fully bonded and had material properties as shown in Tables 2 and 3.

Example 4

The same nonwoven web was formed as described in Comparative Example 4, but with an additional step of hydro-patterning. The hydro-patterning was achieved with two drums with the same setting—a wiremesh screen and two injectors at the drum, each applying a water pressure of 125 bar. Each injector had two rows of holes, with the holes within each row spaced a distance of 0.6 mm from one another (type 2j12). The fabric was moving at a speed of 300 m/min. The resulting nonwoven web had material properties as shown in Tables 2 and 3.

Comparative Example 5 (Precursor Web to Example 5)

A 25 gsm spunmelt type nonwoven batt was produced online in a continuous process from a mixture of polypropylene (Mosten NB425 from Unipetrol) and copolymer (Vistamaxx 6202 from Exxon) in the weight ratio 95:5, color additive (SCC 91056 from Standridge Color Corporation) and soft enhancing additive based on erucamide (CESA-slip PP 42161 from Avient), where monocomponent polypropylene filaments with a fiber diameter of 13-25 μm were produced and subsequently collected on a moving belt. The batt was produced on REICOFIL 3.1 technology from four beams. The nonwoven batt was fully bonded by a pair of heated rollers, where one roller had raised Pattern P5 (FIG. 9). The temperature of the calender rollers (smooth roller/patterned roller) was 162° C./162° C. and the bonding pressure was 105 N/mm. The resulting nonwoven web was considered fully bonded and had material properties as shown in Tables 2 and 3.

Example 5

The same nonwoven web was formed as described in Comparative Example 5, but with an additional step of hydro-patterning. The hydro-patterning was achieved with two drums with the same setting—a wiremesh screen and two injectors at the drum, each applying a water pressure of 125 bar. Each injector had two rows of holes, with the holes within each row spaced a distance of 0.6 mm from one another (type 2j12). The fabric was moving at a speed of 300 m/min. The resulting nonwoven web had material properties as shown in Tables 2 and 3.

Comparative Example 6 (Precursor Web to Example 6)

A 35 gsm spunmelt type nonwoven batt was produced online in a continuous process from a mixture of polypropylene (type 3155E5 from Exxon) with color additive (SCC 91056 from Standridge Color Corporation), where monocomponent polypropylene filaments with a fiber diameter of 13-25 μm were produced and subsequently collected on a moving belt. The batt was produced on REICOFIL 5 technology from three spunbond beams. The nonwoven batt was fully bonded by a pair of heated rollers, where one roller had raised Pattern P6 pattern (FIG. 5). The temperature of the calender rollers (smooth roller/patterned roller) was 160° C./162° C. and the bonding pressure was 75 N/mm. The resulting nonwoven web had material properties as shown in Tables 2 and 3.

Example 6

The same nonwoven web was formed as described in Comparative Example 6, but with an additional step of hydro-patterning. The hydro-patterning was achieved with two drums. The first drum had a wire mesh screen and one injector at the drum applying a water pressure of 80 bar, the one injector at the first drum had two rows of holes, with the holes within each strip spaced a distance of 1.2 mm from one another. The second drum had an MPC screen and three injectors applying water pressure of 90 bar, 90 bar and 150 bar, respectively. The three injectors at the second drum each had two strips of holes, with the holes within each strip spaced a distance of 0.6 mm from one another. The fabric was moving at a speed of 100 m/min. The resulting nonwoven web had material properties as shown in Tables 2 and 3.

Comparative Example 7 (Precursor Web to Example 7)

Figure 4A:
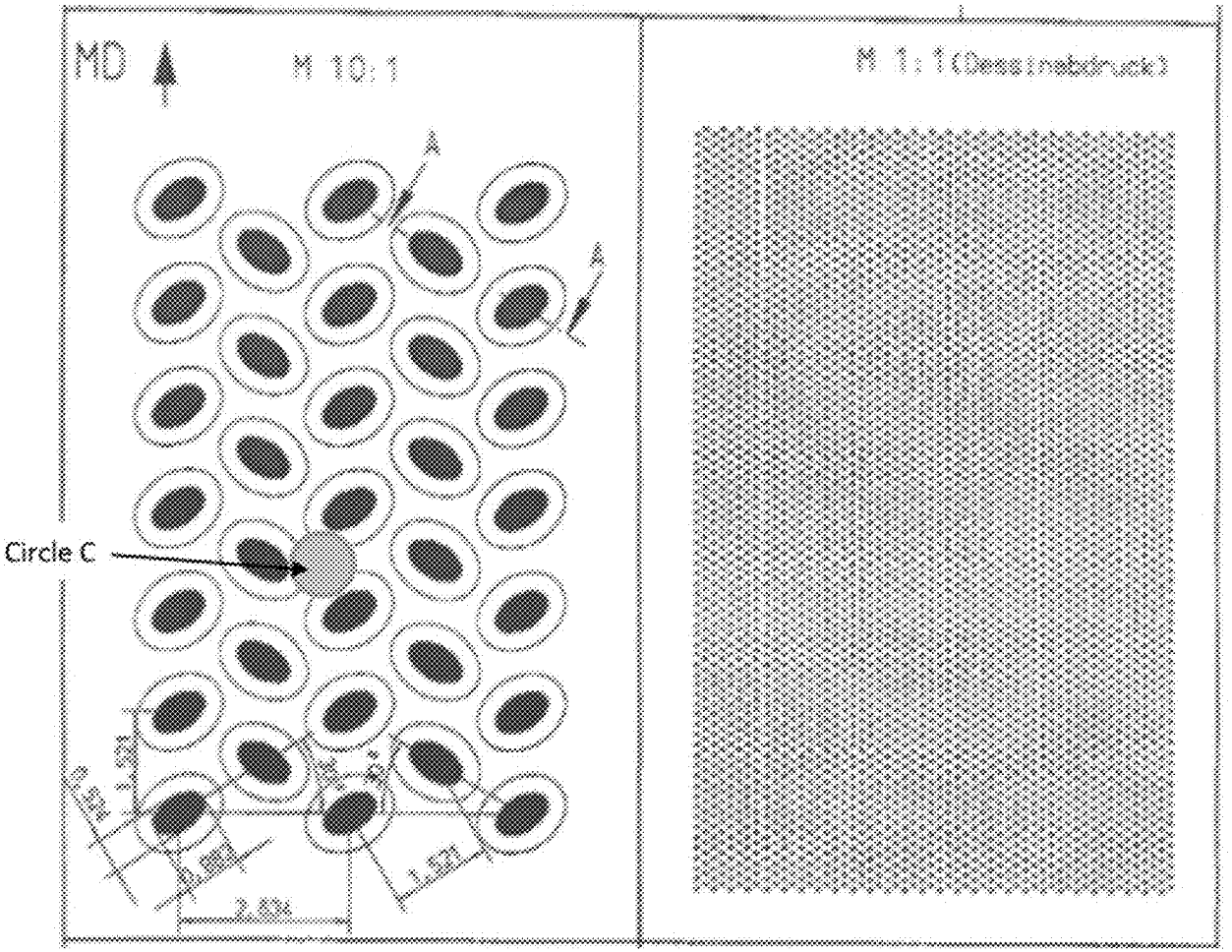
FIG. 4A shows a bonding pattern useable with methods for forming a hydro-patterned nonwoven web according to an exemplary embodiment of the present invention.
Figure 4B:
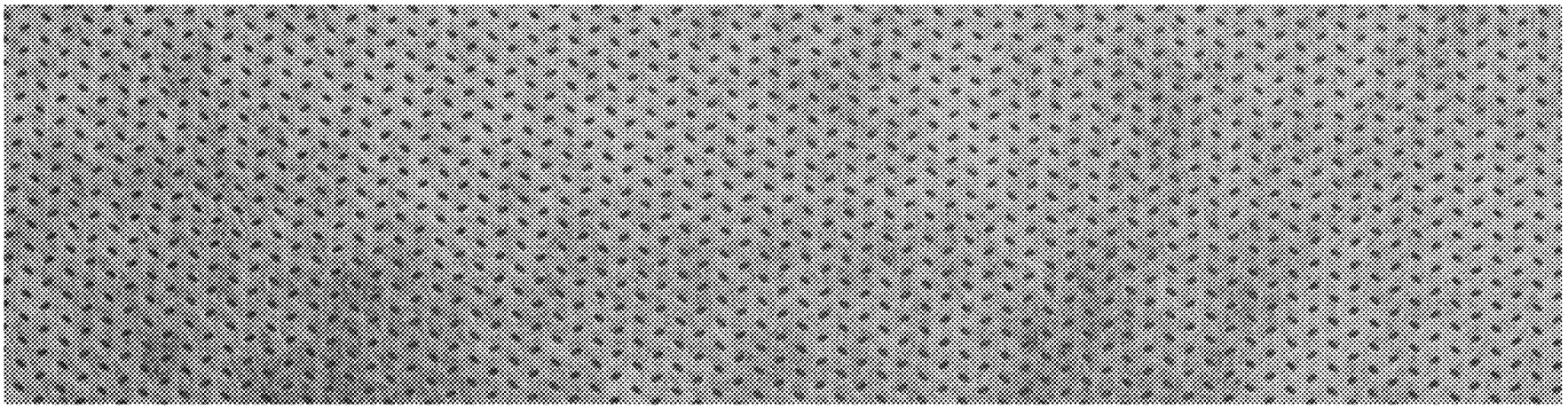
FIG. 4B shows the bonding pattern of 4A on a precursor web according to an exemplary embodiment of the present invention.

A 30 gsm spunmelt type nonwoven batt was produced online in a continuous process from bicomponent filaments of core/sheath type with a ratio of 80:20. The core was formed of aliphatic polyester (PLA Ingeo 6100D from Nature Works) and the sheath was formed of aliphatic polyester with lower melting point and crystallinity (PLA ingeo 6752 s from Nature Works) with slip additive (Avient CR Bio 2144 from Avient). Bicomponent filaments with a fiber diameter of 15-30 μm were produced and subsequently collected on a moving belt. The batt was produced on REICOFIL 4 technology from one spunbond beam. The nonwoven batt was fully bonded by a pair of heated rollers, where one roller had raised Pattern P1 (FIG. 4A). The temperature of the calender rollers (smooth roller/patterned roller) was 140° C./138° C. and the bonding pressure was 50 N/mm. The resulting nonwoven web had material properties as shown in Table 4.

Example 7

The same nonwoven web was formed as described in Comparative Example 7, but with an additional step of hydro-patterning. The hydro-patterning was achieved with two drums. The first drum had a wire mesh screen and one injector at the drum applying a water pressure of 80 bar, the one injector at the first drum had two rows of holes, with the holes within each strip spaced a distance of 1.2 mm from one another. The second drum had an MPC screen and three injectors applying water pressure of 90 bar, 90 bar and 150 bar, respectively. The three injectors at the second drum each had two strips of holes, with the holes within each strip spaced a distance of 0.6 mm from one another. The fabric was moving at a speed of 100 m/min. The resulting nonwoven web had material properties as shown in Tables 2 and 3.

TABLE 2

| Example | Thermal Bond Pattern | Basis Weight g/m$^2$ | MDT, g/cm | CDT, g/cm | Thickness mm | Thickness drop | CDT drop | MDT drop |
|---|---|---|---|---|---|---|---|---|
| COMPARATIVE 1 | P2 | 24.2 | 566 | 285 | 0.27 | | | |
| EXAMPLE 1 | P2 | 24.9 | 367 | 132 | 0.33 | 22% | −54% | −35% |
| COMPARATIVE 2 | P2 | 24.4 | 873 | 471 | 0.297 | | | |
| EXAMPLE 2 | P2 | 24.7 | 685 | 304 | 0.348 | 17% | −35% | −22% |
| COMPARATIVE 3 | P3 | 25.9 | 893 | 512 | 0.276 | | | |
| EXAMPLE 3 | P3 | 25.6 | 870 | 517 | 0.314 | 14% | 1% | −3% |
| COMPARATIVE 4 | P7 | 26.4 | 1345 | 577 | 0.342 | | | |
| EXAMPLE 4 | P7 | 26.6 | 1409 | 556 | 0.381 | 11% | −4% | 5% |
| COMPARATIVE 5 | P5 | 24.8 | 1139 | 678 | 0.29 | | | |
| EXAMPLE 5 | P5 | 25.5 | 808 | 431 | 0.446 | 54% | −36% | −29% |
| COMPARATIVE 6 | P6 | 35.0 | 1105 | 685 | 0.39 | | | |
| EXAMPLE 6 | P6 | 35.2 | 1070 | 599 | 0.75 | 92% | −13% | −7% |
| COMPARATIVE 7 | P6 | 29.9 | 1900 | 710 | 0.37 | | | |
| EXAMPLE 7 | P6 | 30.1 | 1250 | 520 | 0.63 | 70% | −35% | −27% |

TABLE 3

| Example | Thermal Bond Pattern | K (EQUATION 1) | MDE, % | CDE, % | MD H-O-M | CD H-O-M |
|---|---|---|---|---|---|---|
| COMPARATIVE 1 | P2 | | 23 | 31 | 10.4 | 6.3 |
| EXAMPLE 1 | P2 | 9 | 27 | 42 | 8.6 | 4.7 |
| COMPARATIVE 2 | P2 | | 48 | 52 | 7.9 | 5.4 |
| EXAMPLE 2 | P2 | 9 | 33 | 47 | 7.2 | 3.8 |
| COMPARATIVE 3 | P3 | | 54 | 67 | 4.4 | 1.5 |
| EXAMPLE 3 | P3 | 39 | 54 | 71 | 3.5 | 1.8 |
| COMPARATIVE 4 | P7 | | 64 | 77 | 8.7 | 5.67 |
| EXAMPLE 4 | P7 | N/A | 65 | 78 | 11.5 | 7.14 |
| COMPARATIVE 5 | P5 | | 94 | 85 | 10 | 5.65 |
| EXAMPLE 5 | P5 | 229 | 52 | 67 | 10.4 | 5.9 |
| COMPARATIVE 6 | P6 | | 42 | 51 | 12.6 | 5 |
| EXAMPLE 6 | P6 | 24 | 66 | 81 | 13 | 6.3 |
| COMPARATIVE 7 | P3 | | 10 | 33 | 30 | 15.6 |
| EXAMPLE 7 | P3 | 39 | 14 | 54 | 11.3 | 4.2 |

As observed from Table 2, each nonwoven web as described in Examples 1 through 6 is improved as compared to its corresponding Comparative Example in terms of thickness and provides a certain level of drop in mechanical properties. Results differ according to the thermo-bonding pattern on the precursor. Examples 1 and 2 present the difference between lower bonded (not fully bonded) and fully bonded precursor with the same pattern and same process conditions. Both examples provide positive effect on thickness (22% and 17%, respectively), where the lower bonded material provides a higher increase (22%) as compared to the fully bonded material. The differences are not large, but still noticeable. What should be noticed is the difference in the drop in mechanical properties, where the decrease of tensile strength in both CD and MD directions is significantly lower for fully bonded material (−22% in MD and −35% in CD) as compared to that of the lower bonded material (−35% in MD and −54% in CD). As an appropriate level of bonding is an important factor for fabric tensile strength, fully bonded precursors provided higher tensile strength as compared to that provided by lower bonded precursors, and lead to even larger differences in tensile strength after hydro-pattern treatment.

The Examples illustrate influence of various thermobonding pattern types on final fabric properties. Examples 1 and 2 involve the use of a pattern with large-bold bonding impressions with varying free filament areas between the impressions. As expected, this combination provided a medium thickness increase together with a relatively large decrease of mechanical properties. According to current disclosure it can be expected that when large-bold bonding impressions are present in the pattern without varying free filaments areas, such as in the case of pattern P1, the decrease in mechanical properties would be at least the same as that observed in Examples 1 and 2 and the increase in the thickness would not be as high. In contrast, when large bonding impressions are arranged to form larger free filament areas, a higher thickness increase can be expected.

Example 3 illustrates desirable mechanical properties of the precursor provided by line shaped discontinuous bonding impressions arranged in a regular pattern of columns and rows. This design with mutually shifted rows of strait lines provides free filament areas with a circle C having a radius of 0.99 mm. As expected, Example 3 resulted in minimal mechanical drop (values +1% and −3%) and significant increase of thickness (+14%). It should be noted that this increase cannot be compared to Example 1 and 2, because polymer composition differs. The higher amount of copolymer used in the polymer composition of Example 3 leads to a softer fabric with more bendable filaments (see H-O-M values) that do not provide the same level of thickness provided by the slightly stiffer polymer composition used in Example 1 and 2.

Example 4 involves the use of continuous line shaped bonding impressions with convex portions and large areas of free filaments having a circle C with a radius of 2.18 mm. As expected, Example 4 resulted in minimal mechanical drop (−4%; +5%) and noticeable thickness increase (+11%). It can be expected that use of small bonding impressions having the same shape as that of Example 4 would provide a higher thickness increase, as the filaments would not be fixed in a closed continuous bond shape. It should also be expected that large discontinuous line shaped bonding impressions forming a design similar to P7 would provide a thickness increase and also mechanical properties somewhere between that provided by the P7 pattern and the same shape formed of small bonding impressions.

Figure 12B:
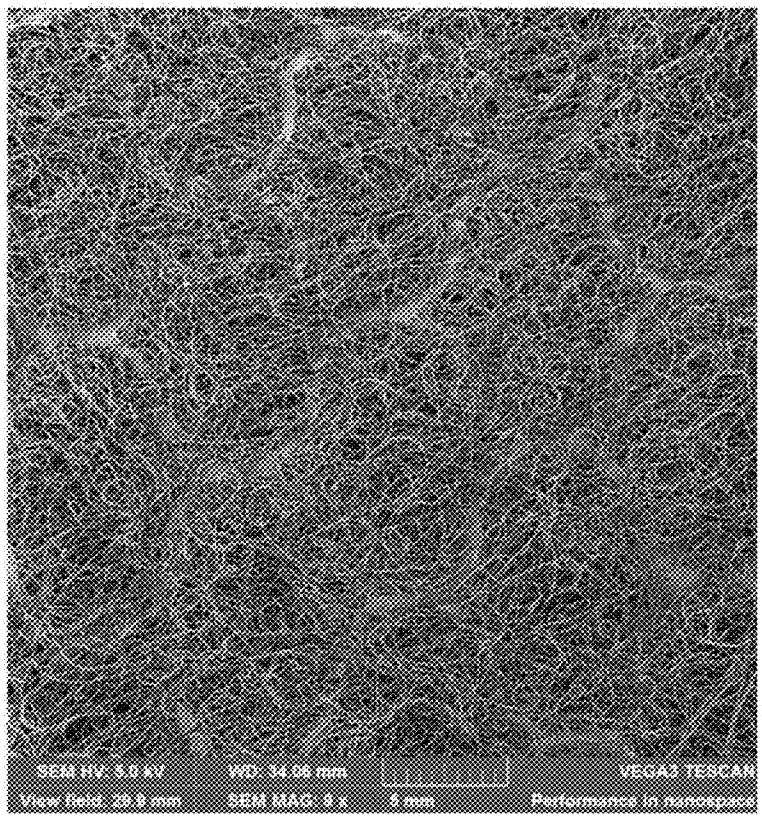
FIG. 12B is micrograph of a hydro-patterned nonwoven web formed from the precursor fabric of FIG. 12A according to an exemplary embodiment of the present invention.
Figure 12A:
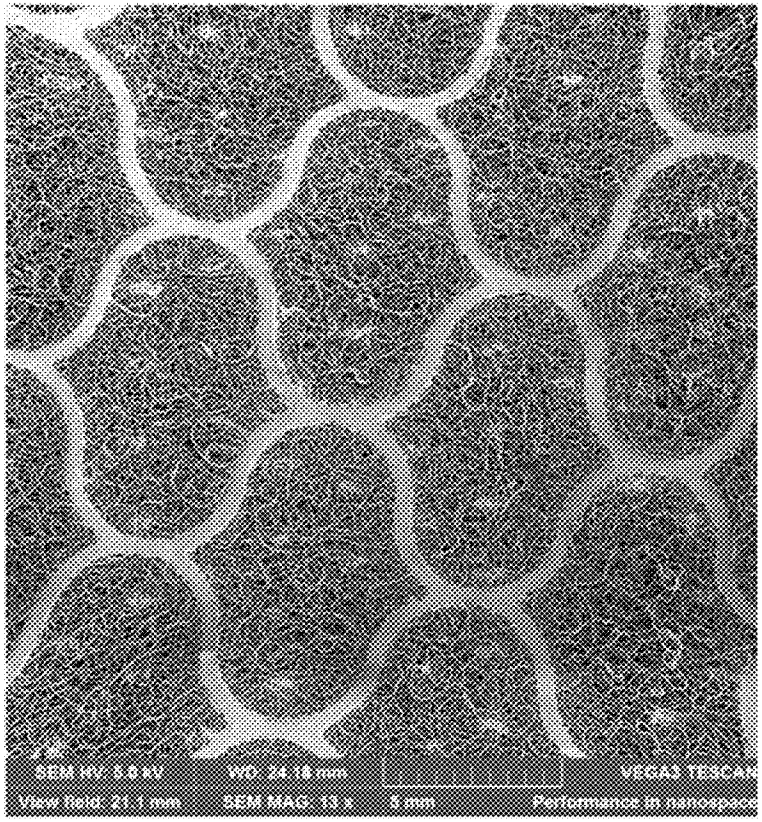
FIG. 12A is a micrograph of a bonding pattern on a precursor fabric according to an exemplary embodiment of the present invention.

Pattern P7 provides a high level of tensile strength (see the MDT value compared to the other Examples) while also providing soft-touch tactile subjective feel in contact with human skin. This subjective value cannot be expressed easily by one measurement and is evaluated by groups of trained people. A significant increase in this subjective soft-touch was observed. Both precursor fabric and treated product was examined under an electronic microscope, and the difference can be seen on FIGS. 12A and 12B. Even though the bonding impression might seem unclear in the hydro-patterned photo, not to be bound by a theory, it is believed the energy flux does not provide enough energy to significantly damage line shaped bonding impressions and might partially change the bonding impression surface to provide a softer human perception. It should be noted that increased soft-touch tactile subjective feel was observed in all hydro-patterned samples.

Example 5 involves the use of pattern P5 formed of a combination of small bonding impressions (0.9 $mm^2$), large bonding impressions (23.7 $mm^2$) and free filament areas (circle C radius 2.54 mm). As expected, high increase in thickness was observed (+54%) in Example 5. Without being bound by theory, it is believed that the high increase in thickness resulted from a large circle C radius in combination with small bonding impressions forming border lines around the free filament areas. The drop in mechanical properties resulting from the presence of large bonding impression is acceptable (−36%; −29%). It should be noted that the final fabric had a visual 3D-like "cushioning" effect resulting from the large bonding points in the P5 pattern.

While in the foregoing specification a detailed description of specific embodiments of the invention was set forth, it will be understood that many of the details herein given may be varied considerably by those skilled in the art without departing from the spirit and scope of the invention.

The "tensile strength" and "elongation" of a nonwoven fabric is measured using testing methodology according to WSP 110.4. R4 (12) standard. Tensile strength can be expressed also as "MDT" for MD direction and "CDT" for CD direction. Accordingly Elongation can be also expressed as "MDE" for MD direction and "CDE" for CD direction.

The "Handle-O-Meter" or "HOM" stiffness of nonwoven materials is performed in accordance with WSP test method 90.3 with a slight modification. The quality of "hand" is considered to be the combination of resistance due to the surface friction and flexural rigidity of a sheet material. The equipment used for this test method is available from Thwing Albert Instrument Co. In this test method, a 100× 100 mm sample was used for the HOM measurement and the final readings obtained were reported "as is" in grams instead of doubling the readings per the WSP test method 90.3. Average HOM was obtained by taking the average of MD and CD HOM values. Typically, lower the HOM values higher the softness and flexibility, while higher HOM values means lower softness and flexibility of the nonwoven fabric.

"Thickness" or "measured height" or "caliper" of a nonwoven material is determined by means of a testing measurement methodology pursuant to European norm EN ISO 9073-2:1995 (corresponds to methodology WSP 120.6), which is modified in the following manner:

1. The material is to be measured by using a sample that is taken from production without being subjected to higher deformation forces or without being subjected to the effect of pressure for longer than a day (for example by the pressure exerted by the roller on the production equipment), whilst otherwise the material must be left for at least 24 hours laying freely on a surface.
2. The total pressure applied for the thickness measurement is 14.7 g/cm$^2$.

"Kinetic coefficient of friction" or "kinetic CoF" of a nonwoven material is determined by using testing Machines Inc. 32-07 Series Friction Tester by means of a ASTM D 1894. The reported data represents the nonwoven-to-nonwoven Kinetic Coefficient of Friction (CoF) on a 10 cm by 10 cm nonwoven placed under a 200 g sled which is pulled across a 25 cm×10 cm clamped sample of the same nonwoven sample, maintaining sidedness and orientation consistency (side A to side A; MD direction to MD direction), at a speed of 150 mm/min.

Figure 13:
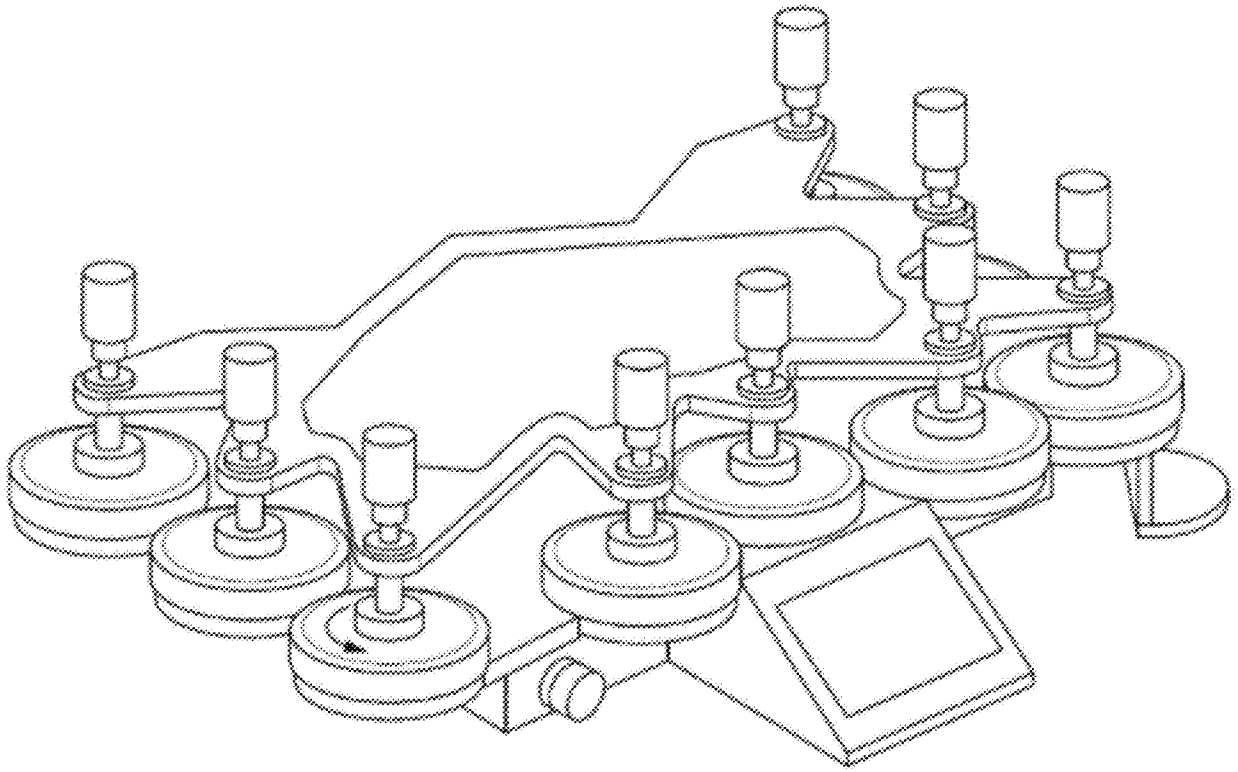
FIG. 13 is a perspective view of a grade scale for fuzz assessment in the Martindale Average Abrasion Resistance Grade Test.

Abrasion rating "Martindale Average Abrasion Resistance Grade Test" or "Martindale" FIG. 13 is a perspective view of equipment for the Martindale Average Abrasion Resistance Grade Test. Specifically, FIG. 13 shows a grade scale for fuzz assessment in the Martindale Average Abrasion Resistance Grade Test Martindale Average Abrasion Resistance Grade of a nonwoven is measured using a Martindale Abrasion Tester. The test is conducted dry.

Figure 14:
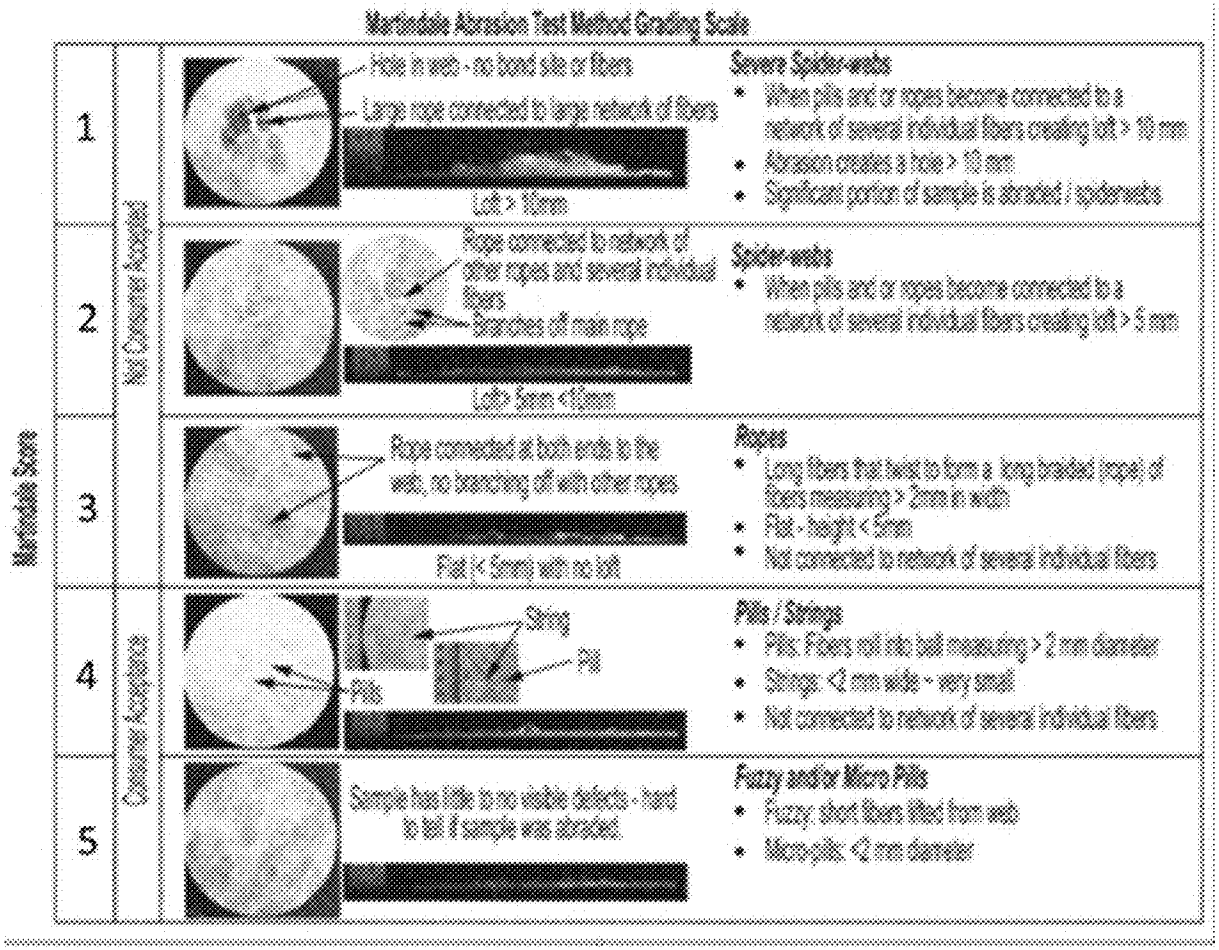
FIG. 14 is a Martindale Abrasion Test Method Grading Scale.

1. Nonwoven samples are conditioned for 24 hours at 23±2° C. and at 50±2% relative humidity.
2. From each nonwoven sample, cut 10 circular samples 162 mm (6.375 inches) in diameter. Cut a piece of Standard Felt into a circle of 140 mm in diameter.
3. Secure each sample on each testing abrading table position of the Martindale by first placing the cut felt, then the cut nonwoven sample. Then secure the clamping ring, so no wrinkles are visible on the nonwoven sample.
4. Assemble the abradant holder. The abradant is a 38 mm diameter FDA compliant silicone rubber 1/32 inch thick (obtained from McMaster Carr, Item 86045K21-50A). Place the required weight in the abradant holder to apply 9 kPa pressure to the sample. Place the assembled abradant holder in the Model #864 such that the abradant contacts the NW sample as directed in the Operator's Guide.
5. Operate the Martindale abrasion under conditions below:
1. Mode: Abrasion Test
2. Speed: 47.5 cycles per minute; and
3. Cycles: 80 cycles in not stated differently
6. After the test stops, place the abraded nonwoven on a smooth, matte, black surface and grade its fuzz level using the scale provided in FIG. 14. Each sample is evaluated by observing both from the top, to determine dimension and number of defects, and from the side, to determine the height of the loft of the defects. A number from 5 to 1 is assigned based on the best match with the grading scale. The Martindale Average Abrasion Resistance Grade is then calculated as the average rating of all samples and reported to nearest tenth.

"Bond Area Percentage" is determined using ImageJ software (Vs. 1.43u, National Institutes of Health, USA) by identifying a single repeat pattern of bond impressions and unbonded areas and enlarging the image such that the repeat pattern fills the field of view. In ImageJ draw a box that encompasses the repeat pattern. Calculate area of the box and record to the nearest 0.01 mm$^2$. Next, with the area tool, trace the individual bond impressions or portions thereof entirely within the box and calculate the areas of all bond impressions or portions thereof that are within the box. Record to the nearest 0.01 mm$^2$. Calculate as follows:

$$\text{Percent Bond Area} = (\text{Sum of areas of bond impressions within box})/(\text{area of box}) \times 100\%$$

Repeat for a total of five non-adjacent ROI's randomly selected across the total specimen. Record as Percent Bond Area to the nearest 0.01%. Measurements are made on both specimens from each article. A total of three identical articles are measured for each sample set. Calculate the average and standard deviation of all 30 of the percent bond area measurements and report to the nearest 0.001 units.

The invention claimed is:

1. A method of forming a hydro-patterned nonwoven web, comprising:

forming a nonwoven batt comprising continuous spunmelt fibers;

calender bonding the nonwoven batt to form a thermobonded precursor nonwoven web with a bond pattern that defines bond impressions and unbonded areas between the individual bond impressions; and hydraulically treating the thermobonded precursor nonwoven by a plurality of steps of water injection as the thermobonded nonwoven web passes over a screen, wherein the bond pattern has a percentage bond area of 10% to 25%, an imaginary circle C is defined as the largest circle that can be drawn among the unbonded areas and which has a perimeter that intersects with a single point on perimeters of each of at least two adjacent bond impressions within the bond pattern, and the circle C has a radius in the unbonded area of at least 0.5 mm, and the bond pattern comprises large-bold bonding impressions with a bond impression area of at least 1 $mm^2$.

2. The method of claim 1, wherein the step of forming the precursor web comprises the spunmelt fibers of the nonwoven batt consisting of spunbond filaments.

3. The method of claim 1, wherein the step of forming the precursor web comprises the nonwoven batt comprising two or more layers.

4. The method of claim 3, wherein the spunmelt fibers in each of the two or more layers comprise spunbond filaments.

5. The method of claim 3, wherein an average fiber thickness difference between the layers is less than 20%.

6. The method of claim 3, wherein at least one layer of the two or more layers comprises spunbond filaments and at least one other layer of the two or more layers comprises meltblown fibers.

7. The method of claim 6, wherein the at least one layer comprising spunbond filaments forms at least one outer layer of the nonwoven batt.

8. The method of claim 7, wherein the two or more layers comprise at least three layers that form a spunbond-meltblown-spunbond (SMS) structure.

9. The method of claim 1, further comprising the step of applying at least one layer formed of fibers and/or particles to the fully bonded nonwoven precursor web before the step of hydraulically treating.

10. The method of claim 9, wherein the fibers are short synthetic fibers.

11. The method of claim 9, wherein the fibers are natural fibers.

12. The method of claim 1, wherein the step of forming the precursor web comprises the continuous spunmelt fibers comprising polyolefin or polyamide or polyester or polysaccharide homopolymer, copolymer or polymer blend.

13. The method of claim 12, wherein the step of forming the precursor web comprises the continuous spunmelt fibers comprising polypropylene, polyethylene, polylactic acid, polyhydroxyalkanoates, polyhydroxybutyrate, polybutylene succinate, polyethylene terephthalate, thermoplastic starch, their copolymers, their copolymers with olefins, esters, amides or other polymers or blends thereof.

14. The method of claim 1, wherein the step of forming the precursor web comprises the spunmelt fibers comprising multi-component, continuous spunmelt fibers.

15. The method of claim 14, wherein a component polymer composition present on at least 40% of each filament surface has a melting temperature that is lower as compared to a melting temperature of at least one other component polymer composition, with a difference of at least 2° C.

16. The method of claim 1, wherein the step of forming the precursor web comprises the spunmelt fibers comprising bicomponent core-sheath continuous spunmelt fibers with a core comprising polypropylene and a sheath comprising a blend of polypropylene and copolymer polypropylene-polyethylene.

17. The method of claim 1, wherein the continuous spunmelt fibers comprise additives.

18. The method of claim 17, wherein the additives comprise additives of a type-selected from the group consisting of: color pigments, softness enhancers, slip agents, fillers and combinations thereof.

19. The method of claim 1, wherein the step of forming the precursor web comprises the bond pattern comprising small bonding impressions with a bond impression area less than 1 $mm^2$.

20. The method of claim 1, wherein the step of forming the precursor web comprises the circle C having a radius of at least 1 mm.

21. The method of claim 1, wherein the step of forming the precursor web comprises the smallest distance between the adjacent bonding impressions being at least 0.3 mm.

22. The method of claim 1, wherein the step of forming the precursor web comprises the bonding impression having the shape of a line with constant width, the line width (W) of maximum 0.6 mm.

23. The method of claim 1, wherein the step of forming the precursor web comprises the bonding impression having the shape of a line with irregular width, the maximum line width (W) of maximum 0.6 mm.

24. The method of claim 1, wherein the step of forming the precursor web comprises the bonding impressions having the shape of a line with bond shape perimeter comprising at least one convex portion.

25. The method of claim 1, wherein the step of forming the precursor web comprises the bonding impressions having the shape of a continuous line.

26. The method of claim 1, wherein the step of forming the precursor web comprises the bonding impressions having the shape of a line with the length (L) at maximum 30 mm.

27. The method of claim 1, wherein the step of forming the precursor web comprises the bond pattern comprising large-bold bonding impressions with bond impression area equal or larger than 1 $mm^2$.

28. The method of claim 1, wherein the step of hydraulically treating comprises applying hydraulic pressure to the nonwoven precursor web with water jets.

29. The method of claim 28, wherein the step of hydraulically treating comprises applying hydraulic pressure to the nonwoven precursor web by at least two sets of water injectors.

30. The method of claim 29, wherein the method is performed at a line speed of at least 150 m/min.

31. The method of claim 30, wherein the line speed is 450 m/min or less.

32. The method of claim 1, wherein the step of hydraulically treating comprises applying hydraulic pressure to the nonwoven precursor web by more than one set of water injectors with each set of water injectors applying a pressure that is greater than a pressure applied by a set of water injectors preceding the set of water injectors in the machine direction.

33. The method of claim 32, wherein the three sets of water injectors comprise a first set of water injectors, a second set of water injectors preceding the first set of water injectors in the machine direction and a third set of water injectors preceding the first and second water injectors in the machine direction, the second set of water injectors apply a pressure of between 80% to 95% of the pressure applied by the first set of water injectors, and the third set of water injectors apply a pressure of between 64% to 90% of the pressure applied by the second set of water injectors.

34. The method of claim 1, wherein the step of hydraulically treating comprises at least partially altering the individual bond impressions by application of water pressure.

35. The method of claim 34, wherein the step of at least partially altering results in at least 60% of fully bonded portions of the individual bond impressions remaining after the step of hydraulically imparting.

36. The method of claim 34, wherein the step of at least partially altering results in at least 70% of fully bonded portions of the individual bond impressions remaining after the step of hydraulically imparting.

37. The method of claim 34, wherein the step of at least partially altering results in at least 80% of fully bonded portions of the individual bond impressions remaining after the step of hydraulically imparting.

38. The method of claim 34, wherein the step of at least partially altering results in at least 90% of fully bonded portions of the individual bond impressions remaining after the step of hydraulically imparting.

39. The method of claim 34, wherein the step of at least partially altering results in separating the individual bond impressions into at least two portions.

40. The method of claim 34, wherein the step of at least partially altering results in fibers in areas around perimeters of the individual bond impressions randomly frayed in and out of a major plane of the fully bonded precursor nonwoven web so as to at least partially eliminate three-dimensionality of the individual bond impressions.

41. A method of forming a hydro-patterned nonwoven web, comprising:

forming a nonwoven batt comprising continuous spunmelt fibers;

calender bonding the nonwoven batt to form a thermobonded precursor nonwoven web with a bond pattern that defines bond impressions and unbonded areas between the individual bond impressions; and hydraulically treating the thermobonded precursor nonwoven by a plurality of steps of water injection as the thermobonded nonwoven web passes over a screen, wherein the bond pattern has a percentage bond area of 10% to 25%, the bond pattern comprises small bonding impressions with a bond impression area less than 1 $mm^2$, and the bond pattern comprises large bonding impressions with a bond impression area of at least 1 $mm^2$.

42. A method of forming a hydro-patterned nonwoven web, comprising:

forming a nonwoven batt comprising continuous spunmelt fibers;

calender bonding the nonwoven batt to form a thermobonded precursor nonwoven web with a bond pattern that defines bond impressions and unbonded areas between the individual bond impressions; and hydraulically treating the thermobonded precursor nonwoven by a plurality of steps of water injection as the thermobonded nonwoven web passes over a screen, wherein the regular bond pattern has a percentage bond area of 10% to 25%, the bond pattern comprises large bonding impressions with a bond impression area of at least 1 $mm^2$, the bonding impression has the shape of a line with irregular width, the maximum line width (W) of maximum 0.6 mm, and bonding impression has the shape of a line with a length (L) of at least 30 mm and a maximum of 25 mm.

* * * * *